US009852620B1

(12) United States Patent
Hoeft

(10) Patent No.: US 9,852,620 B1
(45) Date of Patent: Dec. 26, 2017

(54) SYSTEM AND METHOD FOR DETECTING SOUND AND PERFORMING AN ACTION ON THE DETECTED SOUND

(71) Applicant: Thomas John Hoeft, Pasco, WA (US)

(72) Inventor: Thomas John Hoeft, Pasco, WA (US)

( * ) Notice: Subject to any disclaimer, the term of this patent is extended or adjusted under 35 U.S.C. 154(b) by 368 days.

(21) Appl. No.: 14/491,946

(22) Filed: Sep. 19, 2014

(51) Int. Cl.
*G08C 23/02* (2006.01)
*G08B 21/02* (2006.01)

(52) U.S. Cl.
CPC ..... *G08C 23/02* (2013.01); *G08B 21/02* (2013.01)

(58) Field of Classification Search
None
See application file for complete search history.

(56) References Cited

U.S. PATENT DOCUMENTS 4,417,235 A * 11/1983 Del Grande ..... G08B 1/08 340/384.71
4,450,436 A * 5/1984 Massa ..... G08B 1/08 181/139
4,611,198 A * 9/1986 Levinson ..... G08B 29/12 340/531
5,999,089 A * 12/1999 Carlson ..... G08B 1/08 340/328
6,624,750 B1 * 9/2003 Marman ..... G08B 25/003 340/4.3
7,015,807 B2 * 3/2006 Roby ..... G08B 1/08 340/511
7,148,797 B2 * 12/2006 Albert ..... G08B 17/00 340/506
8,269,625 B2 * 9/2012 Hoy ..... G08B 3/10 340/539.1
8,558,708 B2 * 10/2013 Albert ..... G08B 3/10 181/151
9,349,372 B2 * 5/2016 Fusakawa ..... G10L 25/51
2016/0117905 A1 * 4/2016 Powley ..... G08B 21/18 340/521

* cited by examiner

*Primary Examiner* — Toan N Pham
*Assistant Examiner* — Rajsheed Black-Childress
(74) *Attorney, Agent, or Firm* — Patrick J.S. Inouye; Krista A. Wittman

(57) ABSTRACT

A system and method for sonically connecting special devices is provided. A plurality of devices is monitored. One or more sound profiles are maintained on each of the devices, wherein at least one of the sound profiles on each device is for a sound emitted by one other device in the plurality. A sound is detected on one of the devices and the detected sound is compared to one or more of the sound profiles stored on that device. A match is identified between the detected sound and one of the sound profiles. One or more response actions are performed based on the identified match.

8 Claims, 22 Drawing Sheets

160

SYSTEM AND METHOD FOR DETECTING SOUND AND PERFORMING AN ACTION ON THE DETECTED SOUND

FIELD

This application relates in general to remotely interacting with customers, and, in particular, to a computer-implemented system and method detecting sound and performing an action based on the detected sound.

BACKGROUND

Smoke alarms are heavily relied on to detect smoke, such as caused by a fire, and to alert individuals of the fire, while fire alarms detect a presence of fire and generate an alert. Generally, the alarms are the first indicator of a fire and are instrumental in assisting individuals to timely escape. The National Fire Protection Association estimates that almost two-thirds of home fire deaths resulted from fires in which the home did not have a working smoke alarm. Placement of the smoke alarms and maintenance are extremely important to ensure the alarms are effective in providing a warning. For example, the U.S. Fire Administration recommends installing a smoke alarm on each floor of a property. Further, with regards to residential properties, the U.S. Fire Administration recommends a smoke alarm in every bedroom and in the hallway outside of each bedroom.

Most battery powered alarms function autonomously. Thus, alarms closest to a fire will sound first, while other alarms will not sound until the fire is in a predefined range of those alarms. In one example, a two-story house has an alarm on the first floor and the second floor. A fire starts in the kitchen, which is on the first floor, and the alarm sounds. However, a family asleep on the second floor cannot hear the alarm sounding on the first floor. By the time the alarm on the second floor sounds, the family has lost precious time in escaping the fire and finds themselves in a dangerous and possibly life-threatening situation.

To prevent such situations, wireless interconnectable smoke alarms, such as by Kidde, utilize radio frequency to provide a warning such that when one alarm sounds, the other connected alarms also sound. However, the wireless smoke alarms of Kidde can only communicate with one another via radio frequency and merely provide a warning alarm, rather than instructions for escaping the facility in which a fire is burning. While wireless networks provide the ability to communicate, they are only able to communicate with one another and are unable to communicate with other types of devices, such as those that are commonly found in residential and commercial dwellings. In contrast, sonically connected devices offer the ability to bridge disparate technologies and have the ability to sense environmental sounds against which the devices are trained to lend themselves to triggering capabilities.

Accordingly, there is a need for a diverse communication system that allows different types of devices to communicate with one another to provide alarms at the same time, as well as instructions for escaping a fire. Preferably, the communication system includes sonic communication.

SUMMARY

To quickly and effectively warn individuals of an impending fire, a group of specialized devices work together to detect the fire, alert other devices, and provide instructions for escaping the fire. Each individual device stores a profile for one or more sounds. When one of the devices observes a sound, such as from another device that has detected fire or smoke, the sound is compared with each of the stored profiles. If a match between the observed sound and one of the profiles is detected, the device sounds an alarm or repeats an existing alarm as a radio frequency wireless network notification to other devices within a common network. In lieu of or in addition to the alarm, provides an instruction for escaping the facility in which the fire has been detected.

An embodiment provides a system and method for sonically connecting special devices. A plurality of devices is monitored. One or more sound profiles are maintained on each of the devices, wherein at least one of the sound profiles on each device is for a sound emitted by one other device in the plurality. A sound is detected on one of the devices and the detected sound is compared to one or more of the sound profiles stored on that device. A match is identified between the detected sound and one of the sound profiles. One or more response actions are performed based on the identified match.

Still other embodiments of the present invention will become readily apparent to those skilled in the art from the following detailed description, wherein are described embodiments by way of illustrating the best mode contemplated for carrying out the invention. The other embodiments can include an analysis of spectra or event detection in acoustic or optics fields. As will be realized, the invention is capable of other and different embodiments and its several details are capable of modifications in various obvious respects, all without departing from the spirit and the scope of the present invention. Accordingly, the drawings and detailed description are to be regarded as illustrative in nature and not as restrictive.

DETAILED DESCRIPTION

Smoke and fire alarms are conventionally used to detect fires and alert individuals. However, many of the alarms function autonomously and require individual detection of the fire before sounding the alarm. Alternatively, wireless alarm systems allow detection of a fire by a single alarm to trigger other alarms and generate an alert, rather than waiting for each individual alarm to detect the fire. However, current wireless systems include only specific alarms. Further, the wirelessly connected alarms only sound an alert and fail to provide instructions for escaping from or stopping the fire. In contrast, sonically connected devices offer a wide spectrum of environmental stimuli that can be sampled and directly responded to with association rules unlike existing systems that typically relay alarm information to a central processing location, such as a 911 dispatch center. To provide individuals with a maximum amount of time to escape from a detected emergency, as well as instructions for escaping, sonically connected devices sound an alert and can provide instructions for the escape.

Figure 1:
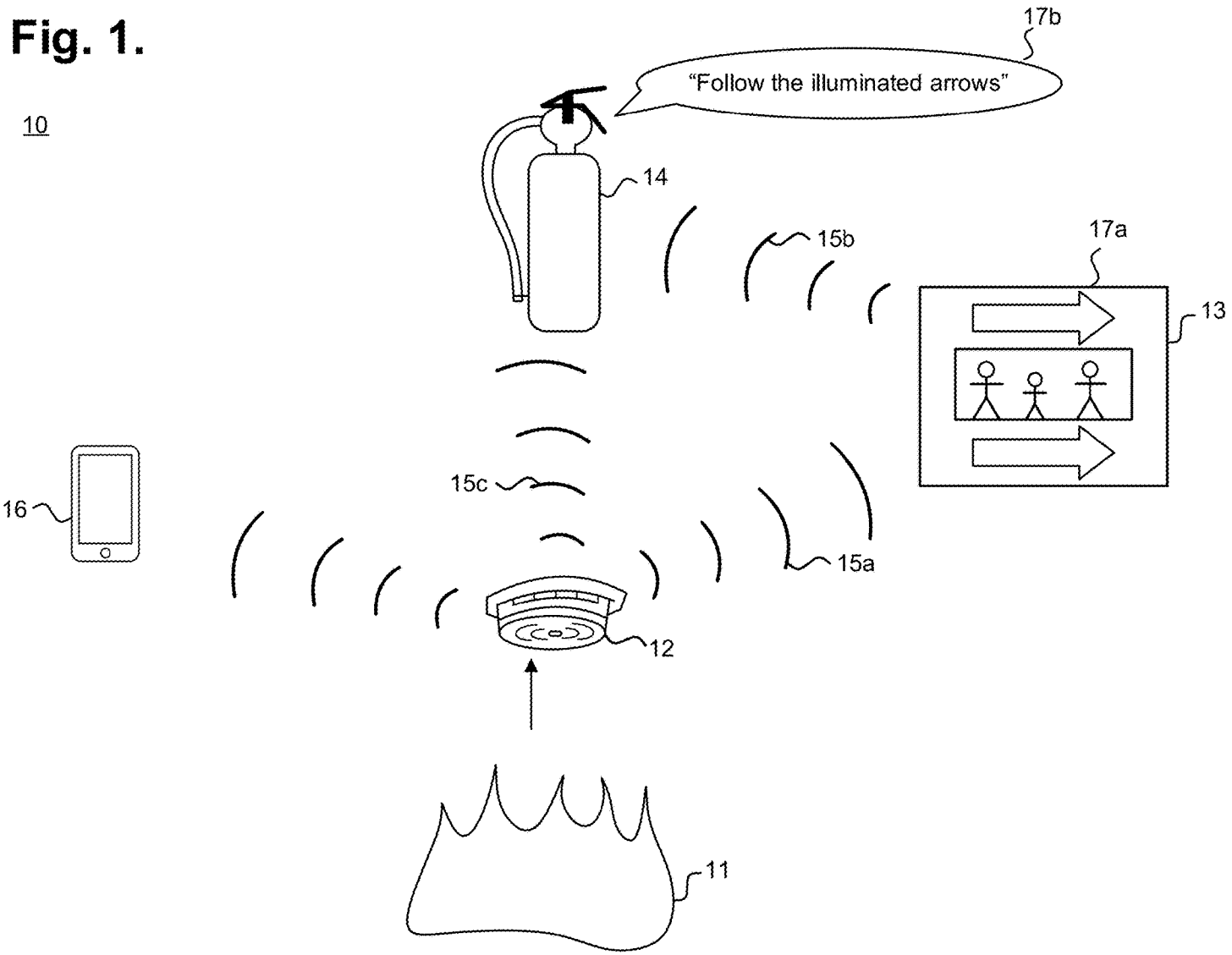
FIG. 1 is a block diagram showing a system for sonically connecting communication devices, in accordance with one embodiment.

The devices are trained to recognize a sound emitted from one or more other devices. FIG. 1 is a block diagram showing a system for sonically connecting communication devices, in accordance with one embodiment. The communication devices can be installed within a facility, such as a house or building and each device can store one or more sound profiles. The communication devices can include a smoke or fire alarm 12, a picture frame 13, and a fire extinguisher 14, as well as other types of objects commonly found in residential or commercial properties, such as smart phones 16, mobile computing devices 16, desktop computers (not shown), tablets (not shown), televisions (not shown), vases (not shown), door frames (not shown), and mirrors (not shown). Each device can act as a combined detector and response device.

In one example, the fire alarm 12 detects a fire 11 burning and emits a signal, such as a sound, that functions as an alert. Hereinafter, the terms "signal" and "sound" are used interchangeably with the same intended meaning, unless otherwise indicated. The sound of the alert is observed by the picture frame 13, fire extinguisher 14, and smart phone 16. Each of the frame 13, fire extinguisher 14, and phone 16 compare the observed sound to the respective stored sound profiles. A determination of whether the observed sound matches one of the sound profiles is made, and if a match is determined to exist, an emergency response action can be performed 17*a*, 17*b*. When the picture frame 13 identifies that the observed sound is from the fire alarm 12, the picture frame displays arrow signs 17*a* directing individuals present in the facility to an exit. Meanwhile, the fire extinguisher plays a pre-recorded message "follow the illuminated arrows" upon detecting a match between the observed sound and one of the stored sound profiles. Alternatively, if the sound emitted from the fire alarm 12 does not match a sound profile, such as those profiles stored on the smart phone 16, no action is taken and the device continues to monitor sounds within the facility.

In a further embodiment, the system of sonically connected communication devices can also be connected via a mesh network to enable the devices to extend a communication range of the devices. For example, a communication device that includes both a mesh network node and a sonic coupling algorithm can communicate alerts from far off nodes that are outside a listening range of the sonic devices. If a fire breaks out in a basement of a two-story dwelling, a mesh network/sonic fire extinguisher located in the basement can be triggered by the sound of a fire alarm, also in the basement. The fire extinguisher can then relay the alert to a communication device located on a second floor of the dwelling. The communication device can then relay a pre-recorded message, such as "fire in the basement."

In yet a further embodiment, other types of wireless networks can be used in addition to or in place of the mesh network. Use of the wireless network allows the communication devices to transmit profiles of trained sounds from one device to another. For instance, an environment that experiences high acoustic distortion includes three communication devices that are linked via a mesh network and are sonically coupled with the environment. A user triggers a test signal on a fire alarm and activates a "training" setting on one of the devices to generate a signal profile. The device conducts the training to sonically connect to the sound of the test signal. Concurrently, the device sends a wireless signal to the two remaining devices, which separately listen to the test signal. Thus, three different training profiles can be recorded in response to a single training test signal. Further, the devices can exchange their signal profiles with one another since the size of each profile is small. The ability to access the profiles of other devices enables each device to be resilient to changes in the environment or acoustical distortion.

Figure 2:
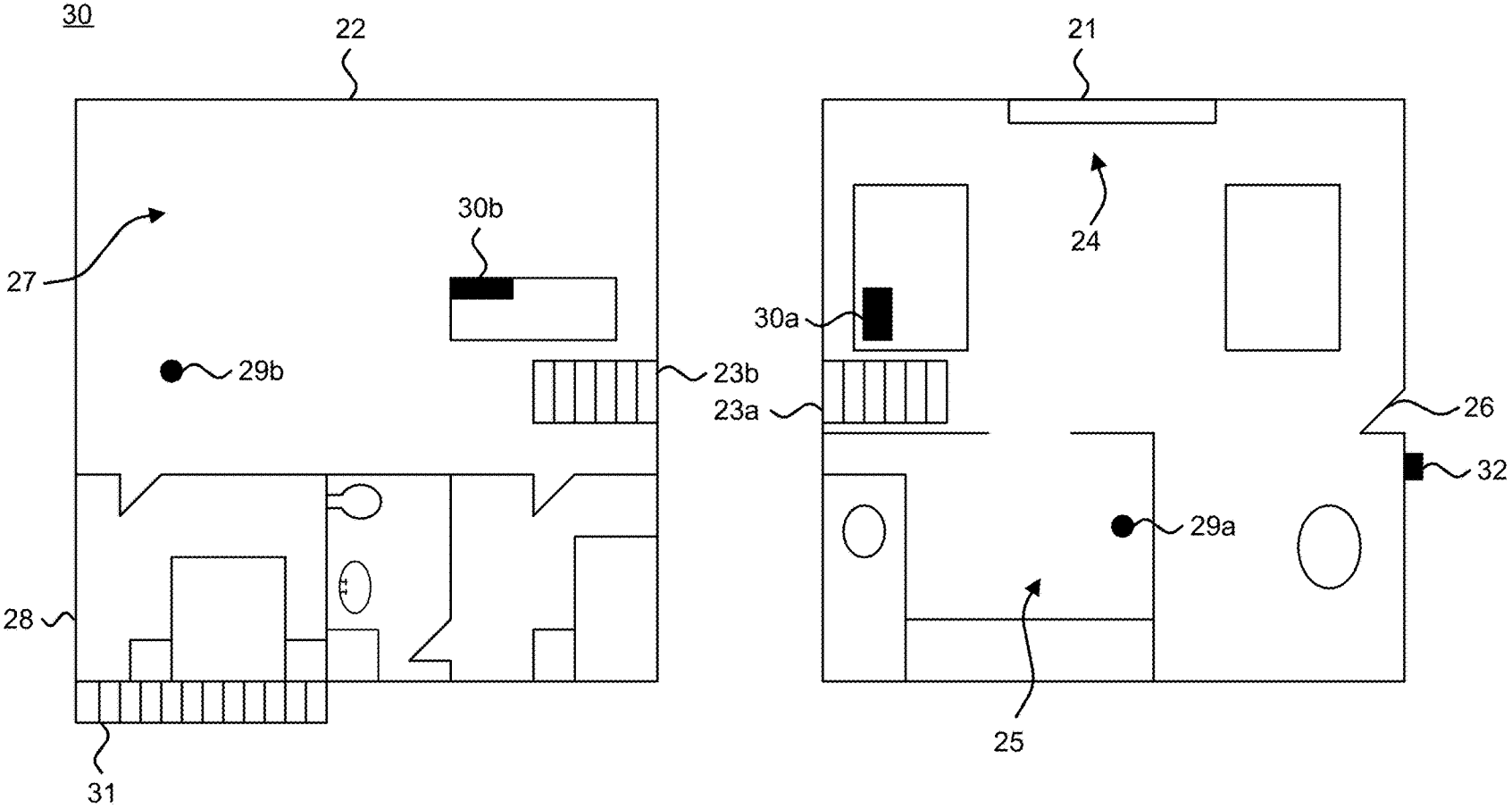
FIG. 2 is a block diagram showing, by way of example, a floor plan of a two-story dwelling with placed communication devices.

To ensure that the devices effectively communicate with one another to provide a warning and instructions for escape, the devices should be carefully placed and installed. FIG. 2 is a block diagram showing, by way of example, a floor plan of a two-story dwelling 30 with placed communication devices 29*a-b*, 30*a-b*. The first floor 21 includes a kitchen 25 with a fire alarm 29*a* installed on the ceiling and a living room 24 with a picture frame 30*a* placed on a desk. Stairs 23*a* and 23*b* lead to the second floor 22. The second floor includes a bonus room 27 with a desk and a picture frame 30*b* adjacent to the stairs 23*b*. A fire alarm 29*b* is also placed in the bonus room 27 directly outside of a bedroom 28.

The communication devices should be appropriately spaced so as to avoid sound distortion or masking between transmission from one device and receipt by another device. For instance, as the distance between devices increases, a natural energy loss of the sound is experienced, which may mask the sound and prevent a device from recognizing the sound. Also, the further the distance between devices, the more opportunity for competing environmental noise, which can cause interpretation problems. In one embodiment, the communicating devices are placed within a range of one to ten feet of each other device. However, other ranges of distances are possible.

In one embodiment, a maximum detection distance can be determined based on a function of alarm intensity, environmental noise intensity, a distance between the alarm and the receiving microphone, environmental materials, geometry of the environments and characteristics of the microphone itself. For example, communication devices can have a detection distance of around 600 meters when an alarm source is 100 dB and the environmental noise is a constant 30 dB. However, other detection distances, alarm sounds, and environmental noise levels are possible.

When the devices are properly placed and installed, the devices can communicate to provide a warning to an individual, as well as instructions or assistance for responding to a cause of the alert. In addition to the example described above with respect to FIG. 1, a fire alarm 29*a* detects a fire in the kitchen 25 on the first floor 21 of the residential dwelling 20. The fire alarm 29*a* emits a sound, which is received by the picture frame 30*a* in the living room 24 on the first floor 21. The picture frame 30*a* processes the sound and makes a determination that the sound is recognized. Subsequently, the picture frame 30*a* sounds an alarm, which is received by the picture frame 30*b* and the fire alarm 29*b* on the second floor. Both the picture frame 30*b* and the fire alarm 29*b* recognize the sound and can play prerecorded messages directing the residents of the dwelling out of the front door 26. In addition to or in lieu of the prerecorded messages, the picture frame 30*b* and fire alarm 29*b* can illuminate using LED backlighting, laser painting on a flat surface, such as a wall, ceiling, or floor, or a retrofit switch for emergency lighting. If the fire is determined to have spread, such that the picture frame 30*a* on the first floor also detects the fire, the picture frame 30*b* and fire alarm 29*b* on the second floor can provide instructions for escaping via a balcony 31 off of the bedroom 28, in addition to or in lieu of illuminating directions for escape.

The communication system can also be used for other scenarios in which alerts or warnings are beneficial. For example, a doorbell 32 outside the front door 32 is pressed by a visitor and a sound emitted by the doorbell is received via the fire alarm 29*a*, which recognizes the sound and emits a further sound for recognition by the picture frame 30*a*. Subsequently, the picture frame 30*a* emits a sound or wireless radio frequency signal that is recognized by the upstairs picture frame 30*b* and fire alarm 29*b*, which each emit a sound so that a resident of the dwelling located in the bedroom 28 can hear the doorbell.

Figure 3:
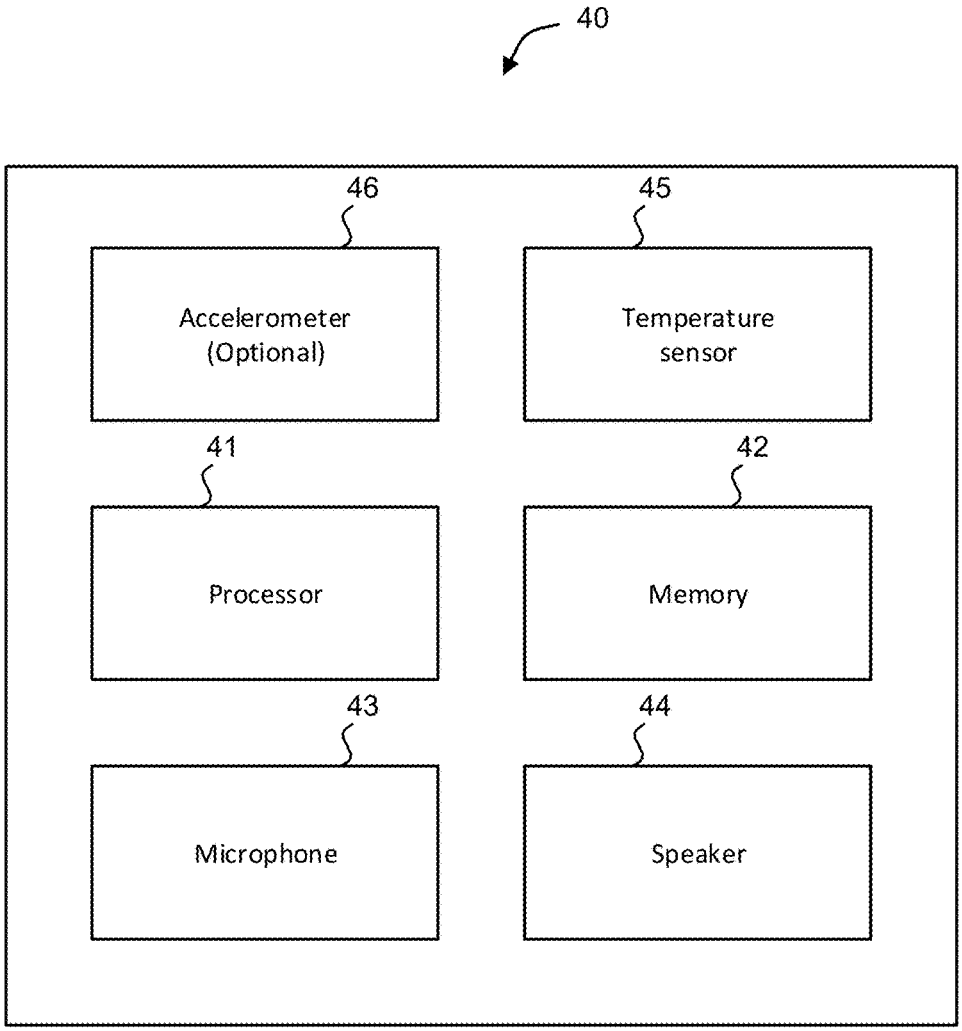
FIG. 3 is a block diagram showing, by way of example, components of a communication device.

Each communication device includes components necessary to input a sound, detect a sound, and emit a sound, as well as perform a response to a detected sound. FIG. 3 is a block diagram showing, by way of example, components of a communication device 40. The communication device can store one or more training sound profiles in a memory 42. A temperature sensor 45 can be used to sense a temperature in the dwelling in which the communication device 40 is installed. Further, the communication device 40 can include a microphone 43 for receiving sound and a processor 41, or central processing unit to determine whether the received sound matches a sound associated with a training profile stored on the communication device.

A speaker 44 can emit a sound or warning upon identification of a high room temperature as determined by the temperature sensor 45 or a sound match by the processor 41. Additionally, the speaker 44 can continue sounding an alarm in case other sensors fail. For example, a detector located in a basement of a building is triggered due to a fire. A further detector located on a first floor of the building is unable to detect the smoke from the fire since a door leading to the basement is closed; however intermittent temperature readings from the basement detector can be transmitted to the upstairs detector to provide notice of the fire, such as via a warning alarm. The fire continues to burn in the basement and eventually, the detector is destroyed. A determination is made as to whether the further detector will be silenced, such as because the threat has been removed or continue sounding a warning alarm. In this example, the further alarm continues to sound due to the previously detected fire in the basement and a failure of the further detector to connect with the basement detector, which can identify a continued threat even though no communication is received from the destroyed downstairs detector. In a further embodiment, the battery of the downstairs dies during the fire. The further alarm can continue to sound despite a termination of communication with the downstairs detector due to the bad battery. Subsequently, the further detector may terminate the alarm when a manual button is pressed or further notice is received that the fire has been put out. Optionally, the communication device 40 can include an accelerometer 46, which detects movement of the device. Upon movement detection, the speaker 44 can emit the sound or warning.

To identify a match, the processor can implement computer-executable code that can be implemented as modules. The modules can be implemented as a computer program or procedure written as source code in a conventional programming language and presented for execution by the central processing unit as object or byte code. Alternatively, the modules could also be implemented in hardware, either as integrated circuitry or burned into read-only memory components. Each of the communications can act as a specialized computer. For instance, when the modules are implemented as hardware, that particular hardware is specialized to perform the data quality assessment and other computers cannot be used. Additionally, when the modules are burned into read-only memory components, the computer storing the read-only memory becomes specialized to perform the data quality assessment that other computers cannot. The various implementations of the source code and object and byte codes can be held on a computer-readable storage medium, such as a floppy disk, hard drive, digital video disk (DVD), random access memory (RAM), read-only memory (ROM) and similar storage mediums. Once a match has been determined, the communication device 40 can perform an action, such as sounding an alert or providing verbal instructions via a speaker 44. Other components are possible.

Figure 4:
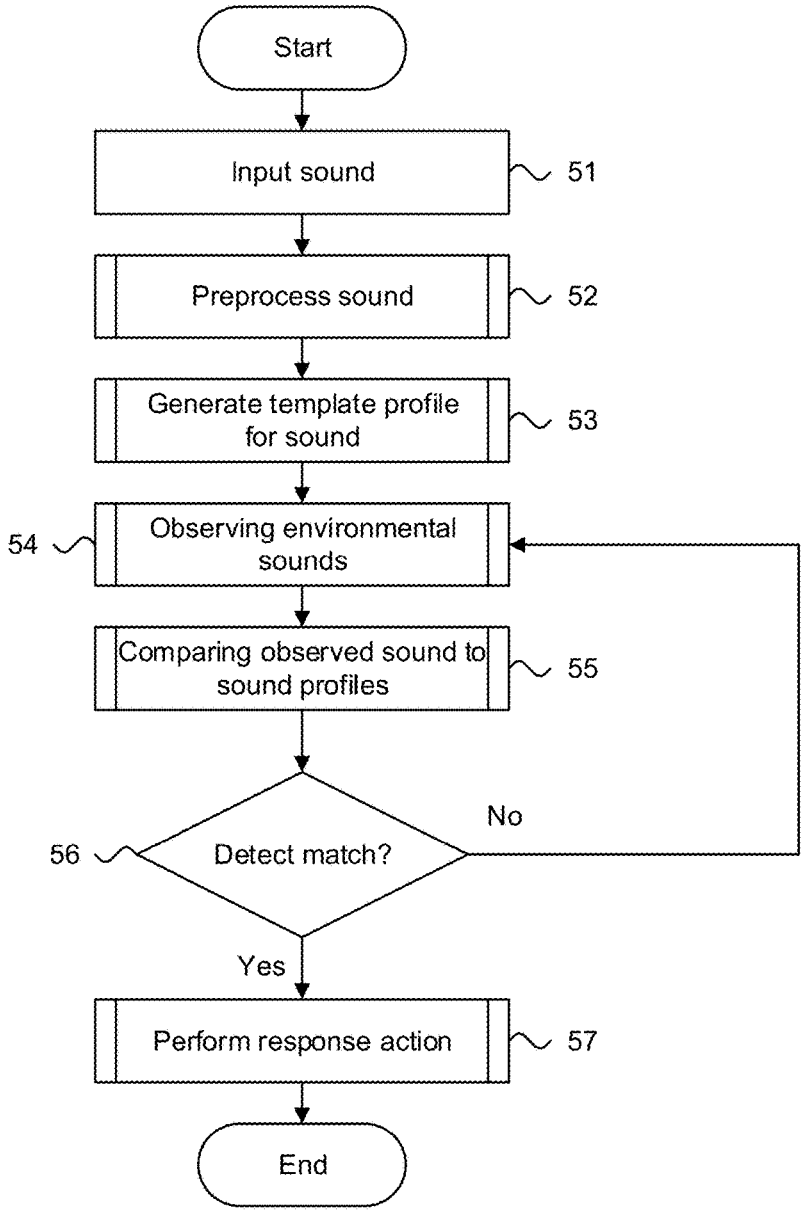
FIG. 4 is a flow diagram showing a method for sonically connecting emergency response devices, in accordance with one embodiment.

Accurately determining whether a match exists can trigger a response action to provide a warning and instructions to an individual for performing a task, such as escaping an emergency or answering a doorbell. FIG. 4 is a flow diagram showing a method 50 for sonically connecting communication devices, in accordance with one embodiment. Sounds are input (block 51) into each of the devices in the communication system. The sounds can be input via sound file formats, such as WAVE and MP3 files, or input streams, such as a hard disk or microphone. Each sound can be loaded into a memory on the device or merely pulled from the input stream. The sound is preprocessed (block 52) and subsequently, a training, or template, profile is generated (block 53) for the sound and stored on the device on which the sound was input. Preprocessing is further described below with respect to FIG. 5, while generating the training profile is further discussed below with reference to FIGS. 7 and 8. The communication devices each monitor the environment in which they are installed and observe sounds (block 54) within the environment. The observed sounds are compared (block 55) to the stored sound profiles and a determination is made as to whether the sound matches (block 56) the sound profile. If no match is identified (block 56), the device continues to monitor sounds in the environment. However, if a match is identified, a response action is performed (block 57).

Each device in the communication system is trained to recognize one or more sounds by receiving a sound and generating a profile for the sound. Preprocessing of a training sound can include time series functional transforms, such as stretching of the data, to enhance the resolution of the communication device to distinguish between similar signals that only differ in pulse length. Stretching helps distinguish the similar signals with shared frequencies using a greater time granularity. During preprocessing, a variety of input formats are normalized to generate an appropriate data structure representation based on a fixed clock speed and an input medium sampling rate.

Figure 5:
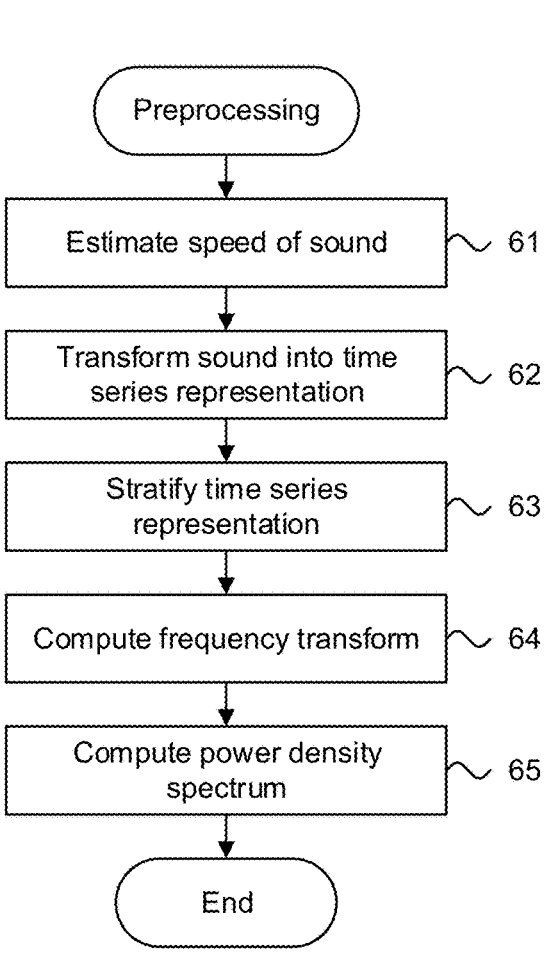
FIG. 5 is a flow diagram showing, by way of example, a process for preprocessing a training sound.

A power density spectrum that represents the sound is generated and used to build a training profile for the sound. FIG. 5 is a flow diagram showing, by way of example, a process 60 for preprocessing a training sound. A device being trained to recognize a particular training sound is identified. A temperature of the environment in which the device is located is determined and a speed of sound is estimated (block 61) based on the temperature. Air density is used to calibrate two identical sounds occurring at different temperatures, otherwise, the identical sounds would have significantly different profiles.

Next, a training sound loaded into the device, as described above with respect to FIG. 4, is transformed (block 62) into a time series representation of amplitude values that correspond to a known clock rate, such as a pulse code modulation representation with a known sample rate. Specifically, the training sound can be loaded from a digital format, such as a WAVE or MP3 file, into a pulse-code modulation (PCM) representation of analog signals or encoded from an analog format and represented as PCM data. In one example, the fixed clock speed is 44.1 Hz. When a data stream or file, such as an MP3 file, has a slower clock speed that corresponds to a transmission encoding, interpolation or other sampling strategies are used to fill in gaps for the data stream or file. However, analog to digital converters or file encoding results in data that is flowing faster than the fixed clock speed. To normalize the data, a down sampling strategy is used, including selecting only those points at a desired rate, averaging the points into bins, and creating multiple bins based on a number of time shifts. Finally, if the data is moves at the fixed clock speed, the data is ready for use.

Subsequently, the pulse code modulation representation is translated to a normalized time series representation of digital samples representing the sound. If background noise of a time series is known, the background noise can be aligned with the signal measured and subtracted from the signal to reduce the noise.

The time series representation is then stratified (block 63) to define a series of windows associated with a window width and window offset. An operational window of the time series has a known number of samples corresponding to a known duration in time since the data input is normalized based on the fixed clock speed. When the operational window is stratified, each of the stratified windows is associated with a known number of samples, or points that include time and amplitude that correspond to a fixed frequency bandwidth using, for example, the Nyquist relation.

The window width and a minimum number of samples for each window can be determined based on a maximum frequency that is expected to be observed and a sample rate of the analog-to-digital converter, or clock speed. In one embodiment, an observation signal has a time series of a known duration, such as 10 seconds, which is stratified into a set of time segments having a duration related to a maximum observable frequency of 7000 Hz. The frequency of 7000 Hz accounts for most standard alarm frequencies that generally range between 3000 and 5000 Hz. Other maximum frequencies are possible; however, alarms with frequencies above 7000 Hz are not likely to be found in residential or commercial structures. A number of samples can be determined using the Nyquist equation provided below:

$$f_{nyquist} = \frac{1}{2} s_r \qquad \text{Eq. 1}$$

where $f_{nyquist}$ is the maximum frequency of 7000 Hz and $s_r$ represents the minimum number of samples per second, which is equal to 14,000 samples per stratified window in this example. Thus, 14,000 time series samples per stratified window are needed to have a frequency spectrum that is capable of measuring power contribution up to 7000 Hz.

An amount of time to measure the determined number of samples, which is 14,000 samples in this example, can be determined based on the clock speed. In one example, the clock speed is 44,100 Hz, which is a default sample rate for generating CD quality sounds. However, other sample rates are possible. The 14,000 time samples per stratified window is divided by the clock speed, 44,100 Hz to determine a window width of 0.317 seconds per stratified window having 14,000 samples at a clock speed of 44,100 Hz. The 10 second observation signal is then divided by the 0.317 seconds per stratified window to determine a number of 31 stratified windows for the time series representation. Meanwhile, the window offset determines a granularity of time resolution and a number of spectra that are used to compute an average power density spectrum.

A frequency transform is computed (block 64) for each stratified window in the time series representation to convert the representation of the training sound based on time to a power density spectrum that is based on amplitude and frequency of the sound wave. The frequency transform can include Fourier Transform, Discrete Fourier Transform, or Fast Fourier Transform, as well as other types of transform. Finally, for each frequency transform of each window, a corresponding power density spectrum is calculated (block 65).

Figure 6:
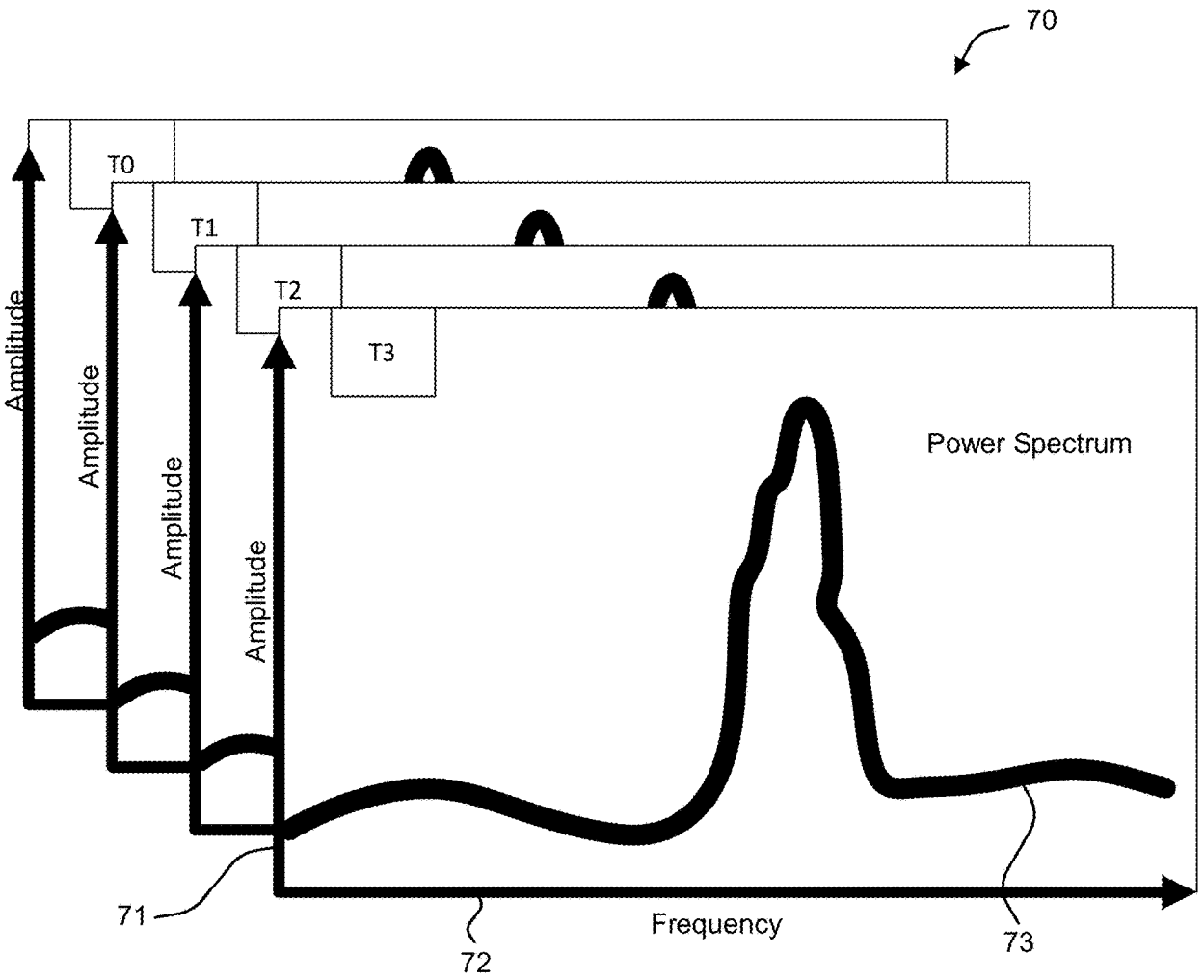
FIG. 6 is a block diagram showing, by way of example, a stack of power spectrum frames generated from a stratified time series.

The power density spectrum for each stratified time window provides a frequency breakdown of the relative power contribution to the signal power for each frequency sampled. FIG. 6 is a block diagram showing, by way of example, graphs 70 of power spectra 73 for a training sound. As described above with reference to FIG. 5, a representation of the sound is stratified into windows. Each window is provided as an array, which is represented as a single graph of a power spectrum 73 in FIG. 6. A vertical axis 71 of the graph represents amplitude of the sound, while a horizontal axis 72 represents frequency of the sound. In the array, the vertical axis is the sound amplitude and the horizontal axis is represented as an array index. Each value stored at an array index represents a sound amplitude. For example, at array index zero, a value corresponding to the Fourier frequency at zero Hertz is identified.

Figure 7:
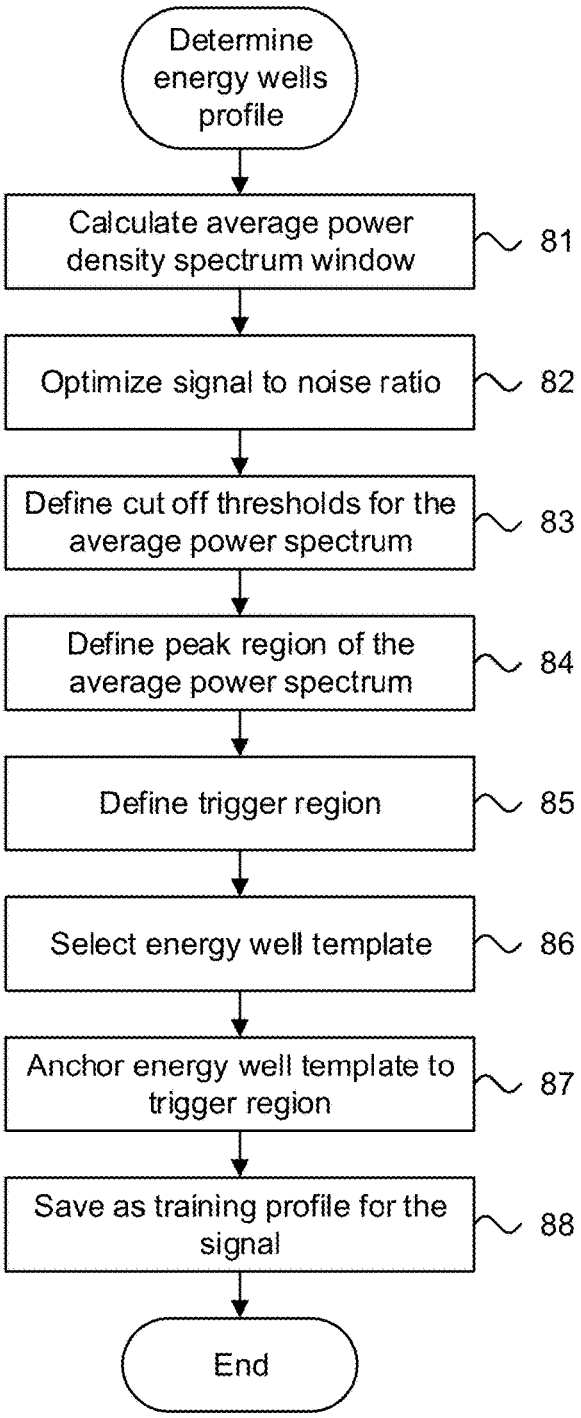
FIG. 7 is a flow diagram showing, by way of example, a process for determining a frequency only profile.
Figure 8:
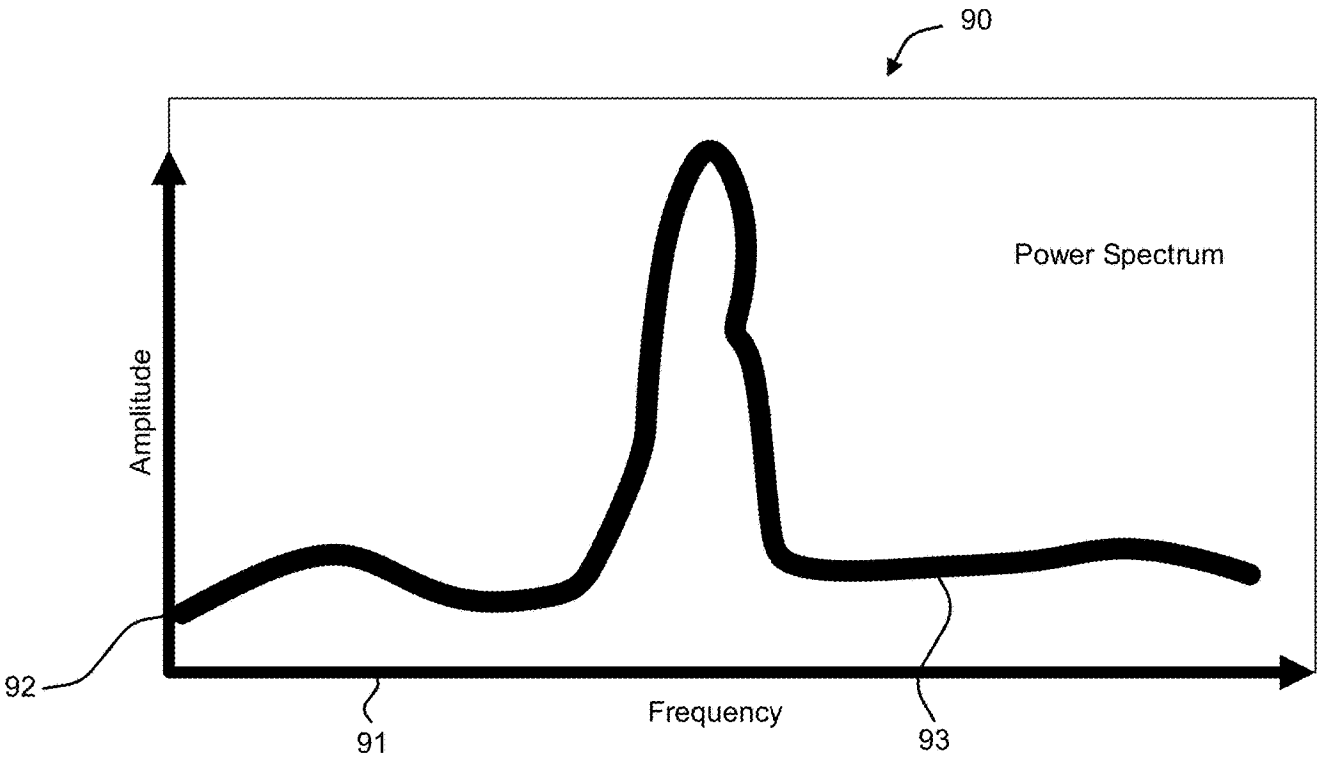
FIG. 8 is a block diagram showing, by way of example, a graph of an average power spectrum.

Once the training sound has been preprocessed and the power density spectra are determined for the "frequency only" phase of generating a training profile, calibration constants and a "frequency only" contribution to the training profile can be calculated. The profile can include calibration data, such as a mean, standard deviation, or temperature, as well as other types of data; frequency data that includes trigger regions with scaled energy wells. FIG. 7 is a flow diagram showing, by way of example, a process 80 for determining a frequency only profile. An average power spectrum is calculated (block 81) by averaging the values over all individual power spectrum arrays. Averaging the power density spectra helps reduce random noise and increase peak fidelity of the spectra. FIG. 8 is a block diagram showing, by way of example, a graph 90 of an average power spectrum 93. The x-axis 91 of the graph 90 represents frequency, while the y-axis 92 of the graph 90 represents amplitude. The average power spectrum 93 is calculated as an average of power density spectra for each stratified window of the training sound. In a further embodiment, the average power spectrum is represented as an array with an array index that is a Fourier frequency.

Figure 9A:
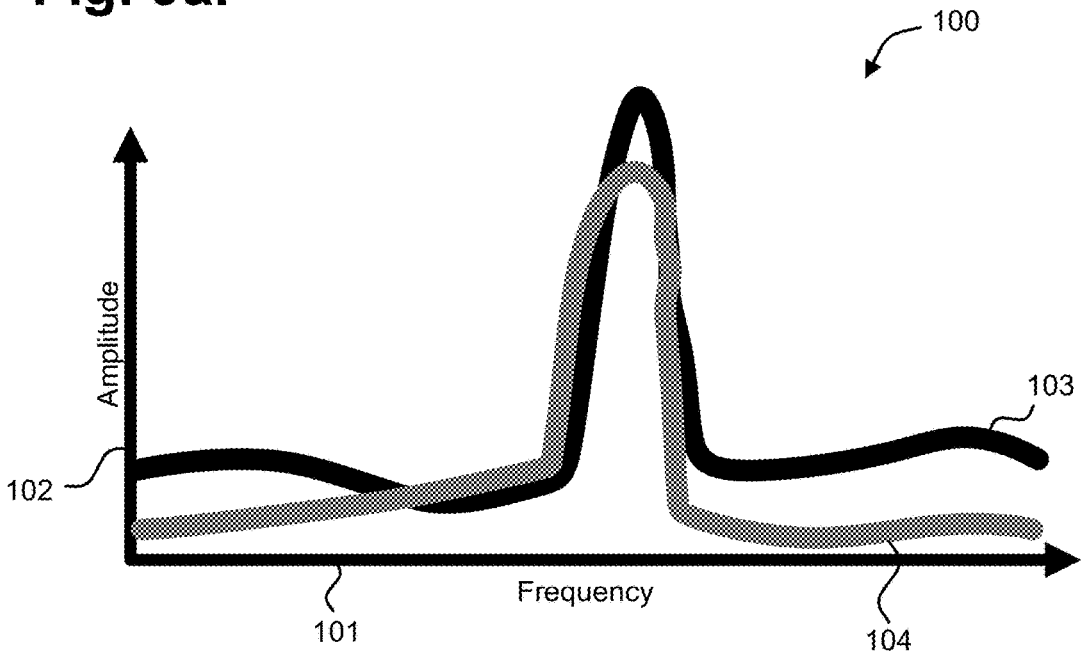
FIG. 9A is a block diagram showing, by way of example, a graph of the average power spectrum and a moving average.
Figure 9B:
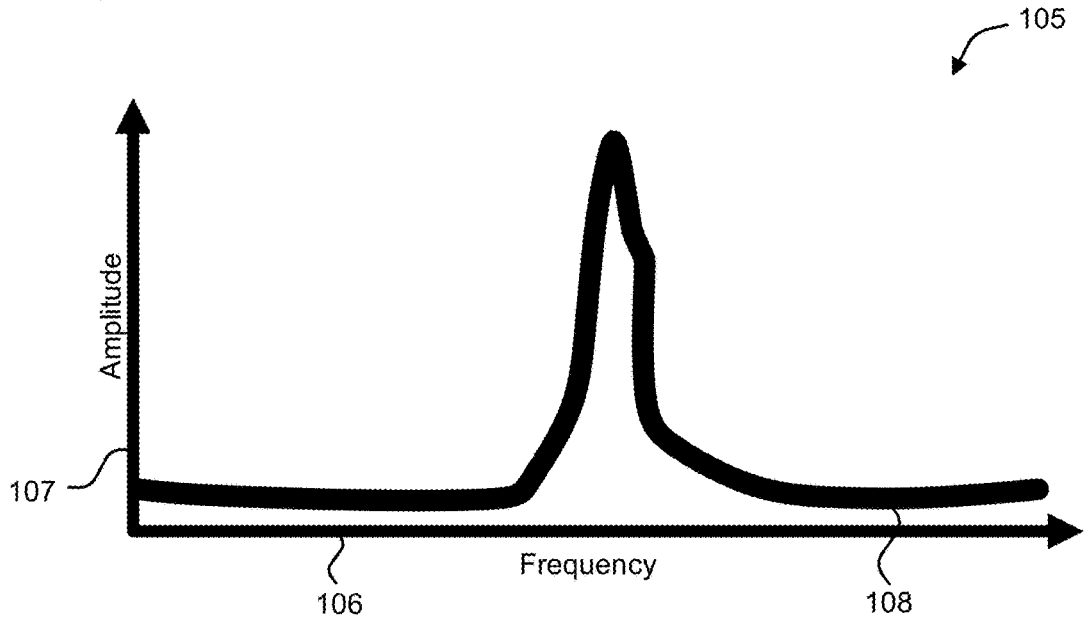
FIG. 9B is a block diagram showing, by way of example, a graph of a cleaned average power spectrum.

Processing of the average power spectrum is performed to further reduce noise and optimize the signal to noise ratio (block 82). Noise reduction can occur via high pass and low pass filters, transformations to other spaces, including frequency and wavelet transforms, and statistical transforms. In one example, a moving average is used to reduce a baseline shift of the average power spectrum by determining a moving average for each point in the power density spectra of the stratified windows and subtracting each corresponding moving average point from the associated point along the power density spectrum. FIG. 9A is a block diagram showing, by way of example, a graph 100 of an average power spectrum 103 and a moving average 104. Each of the average power spectrum 103 and moving average 104 are plotted on an x-axis 101 and a y-axis 102, which represent frequency and amplitude, respectively. The moving average 104 is calculated to approximate noise of the average power spectrum 103 and smooth the shape of the spectrum 103. Subsequently, a new representation of the average power spectrum 103 with reduced noise is generated based on the moving average 104. FIG. 9B is a block diagram showing, by way of example, a graph 105 of a cleaned average power spectrum 108. The graph includes an x-axis 106, which represents frequency and a y-axis 107, which represents amplitude.

Once the noise has been reduced, cutoff thresholds for the cleaned average power spectrum are defined (block 83). The cutoff thresholds, such as $CT_1(x_i)$, $CT_2(x_i)$, and $CT_3(x_i)$, are functions based on signal statistics and are used to make decisions regarding signal landmarks or artifacts. The threshold functions can be linear, such as based upon a signal mean and standard deviation. However, other types of threshold functions are possible. The cutoff thresholds provide a scalable way to compare two different signals using common comparison means and allow for the ability to scale energy wells.

In a further embodiment, the cutoff threshold functions, $CT_1(x_i)$, $CT_2(x_i)$, and $CT_3(x_i)$ can be defined based on signal statistics, such as a mean of the cleaned average power spectrum and a multiple of a corresponding standard deviation, using the following equations:

$$CT_1=\mu \quad \text{Eq. 2}$$

$$CT_2=\mu+1\sigma \quad \text{Eq. 3}$$

$$CT_3=\mu+2\sigma \quad \text{Eq. 4}$$

To determine the cutoff thresholds, $\mu$ represents a mean of the amplitude for the cleaned average power spectrum, while $\sigma$ represents a standard deviation from the mean. A general equation for the cutoff threshold functions is:

$$CT_\alpha(x_i)=\mu+\alpha\sigma \quad \text{Eq. 5}$$

where $\alpha$ represents an offset from the mean by a multiple of a standard deviation. In one embodiment, a value of 1.75 for $\alpha$ is used for $CT_2$.

Figure 10:
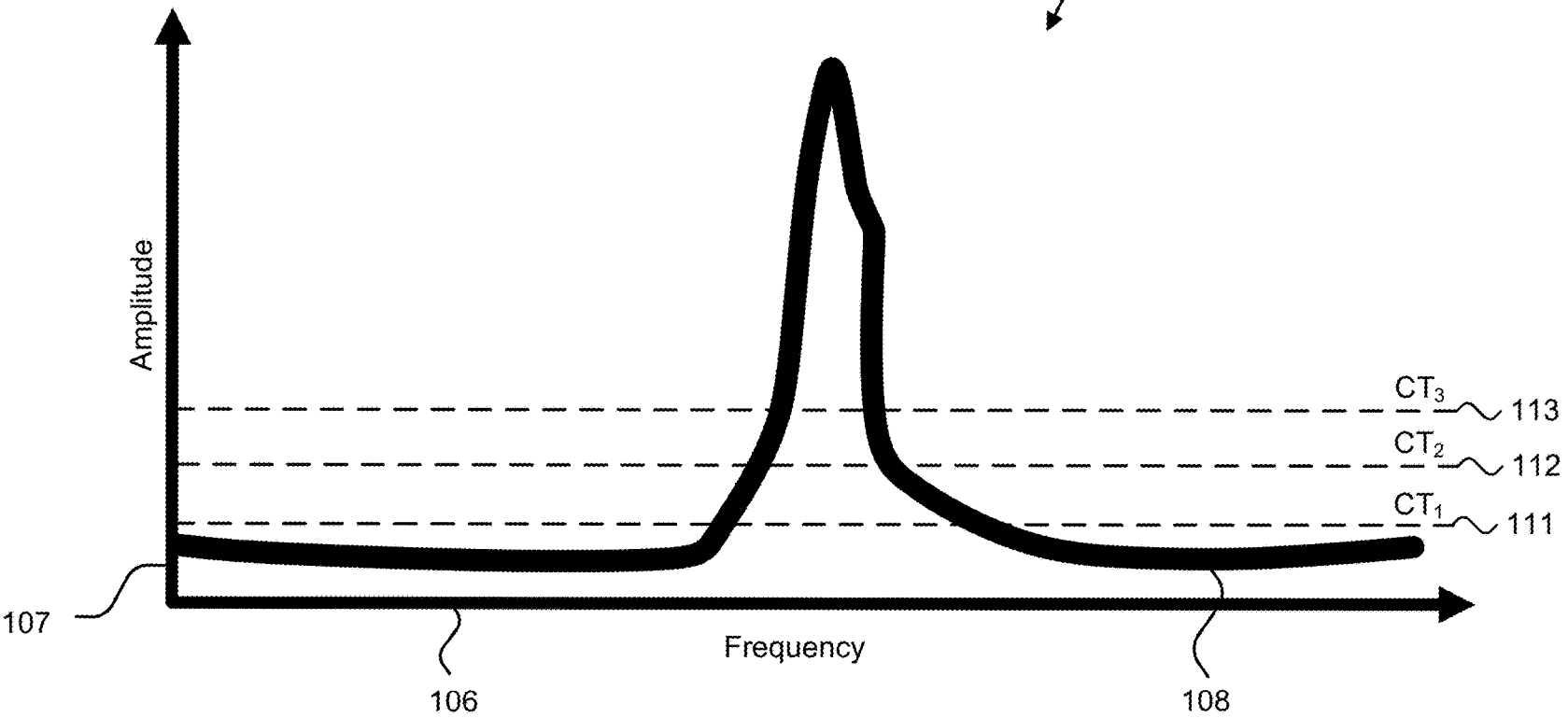
FIG. 10 is a block diagram showing, by way of example, a graph of the cleaned average power spectrum of FIG. 9B with defined cutoff thresholds.

Once determined, the cutoff thresholds are mapped. FIG. 10 is a block diagram showing, by way of example, a graph 110 of the cleaned average power spectrum 108 of FIG. 9B with defined cutoff thresholds 111-113. The x-axis 106 of the graph represents frequency, while the y-axis 107 of the graph represents amplitude. Three cutoff thresholds 111-113 are defined on the graph 110. The first cutoff threshold 111 defines statistical landmarks necessary to "derive decision-making thresholds," $CT_2$ and $CT_3$, and serves as a means of calibrating a learned signal with an observed signal, as further described below.

After the cutoff thresholds are determined, a peak region of the cleaned average power spectrum is defined (block 84). The third cutoff threshold 113 is an energy threshold that defines whether a peak has been discovered during training. The peak is then used to identify a peak region, which includes a set of contiguous points that are greater than or equal to the $CT_3$. Each point in the cleaned average power spectrum is associated with a frequency, amplitude pair ($x_i$, $y_i$). For the points to be contiguous, each point should satisfy the following relationship:

$$x_{i+1}-x_i=1 \quad \text{Eq. 6}$$

Next, an amplitude ($y_i$) of each point should satisfy the following equation:

$$y_i \geq CT_3(x_i) \quad \text{Eq. 7}$$

Figure 11:
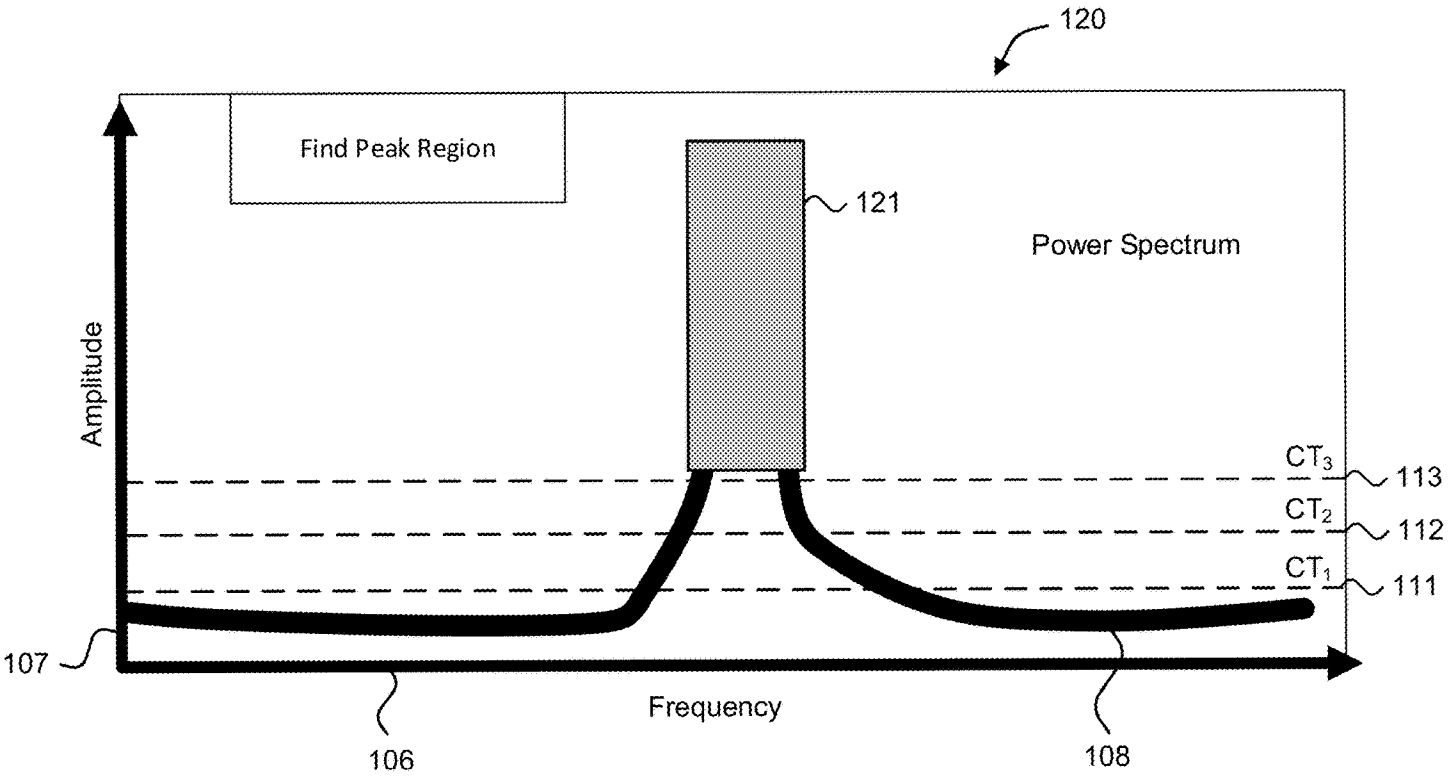
FIG. 11 is a block diagram showing, by way of example, a graph of the cleaned average power spectrum of FIG. 9B with a peak region.

Points that are contiguous and that satisfy the constraints above, are considered to be members of a peak region. Left and right boundaries of each peak region occur at an intersection of the third cutoff threshold with the power density spectrum. FIG. 11 is a block diagram showing, by way of example, a graph 120 of the cleaned average power spectrum 108 of FIG. 9B with a peak region 121. The x-axis 106 of the graph 120 represents frequency and the y-axis 107 represents amplitude. A peak region 121 is defined around a portion of the cleaned average power spectrum 108. Subsequently, a peak of the cleaned average power spectrum is determined to be contained within a corresponding peak region 121.

For each peak region, a trigger region is next defined (block 85). Specifically, a trigger region is a bounding box that uses a peak region as a minimal representation and grows dimensions of that peak region. A length of the peak region is increased by finding a next most appropriate cutoff threshold, such as $CT_2$, or boundary end point rule that intersects with the cleaned average power spectrum. A width of the trigger region is determined via one of three peak termination conditions; however, other peak termination conditions are possible. In a first embodiment, the width of the trigger region is determined by identifying two points at which the amplitude of the cleaned average power spectrum intersects the second cutoff threshold. However, this termination condition may not always effective at defining a trigger region. For example, two different peaks exist, but the lowest amplitude separating these peaks of the cleaned power spectrum is higher than the second cutoff threshold and thus, only one trigger region is identified, rather than two separate trigger regions.

A second embodiment to determine a trigger region width is by determining N-point lead and lag trends that result in an inflection point. The inflection point is then determined to be a division point that distinguishes between two different trigger regions. Finally, a third embodiment to distinguish trigger regions is a boundary collision of one peak region with another peak region. As trigger regions are formed, they increase in width. The mutual exclusion rule is a boundary condition that forces trigger region termination prior to intersection with the peak region. That is to say, a peak region is a subset of a trigger region and a trigger region contains one and only one peak region. In one example, each of the peak termination conditions is applied and the highest number of peaks determined is used to determine a number of trigger regions and a width of each trigger region. Alternately, one or more peak termination conditions can be applied.

The trigger regions within a sound profile are needed for power spectrum analysis because of changes in frequency, which are caused by frequency shifts that occur when environmental conditions cause a frequency component of the spectrum to change such as being partially absorbed by environmental surroundings, changes in temperature, and movement of a sound emitter, as well as other changes. At a minimum, the trigger region should be wide enough to accommodate an expected frequency shift, while remaining narrow enough to distinguish between different frequencies along the x-axis. Further, the widening, or additional points in the trigger region, must be contiguous with the set of points contained within a corresponding peak region. Additionally, every additional point must have an amplitude that is higher than the second cutoff threshold.

Figure 12:
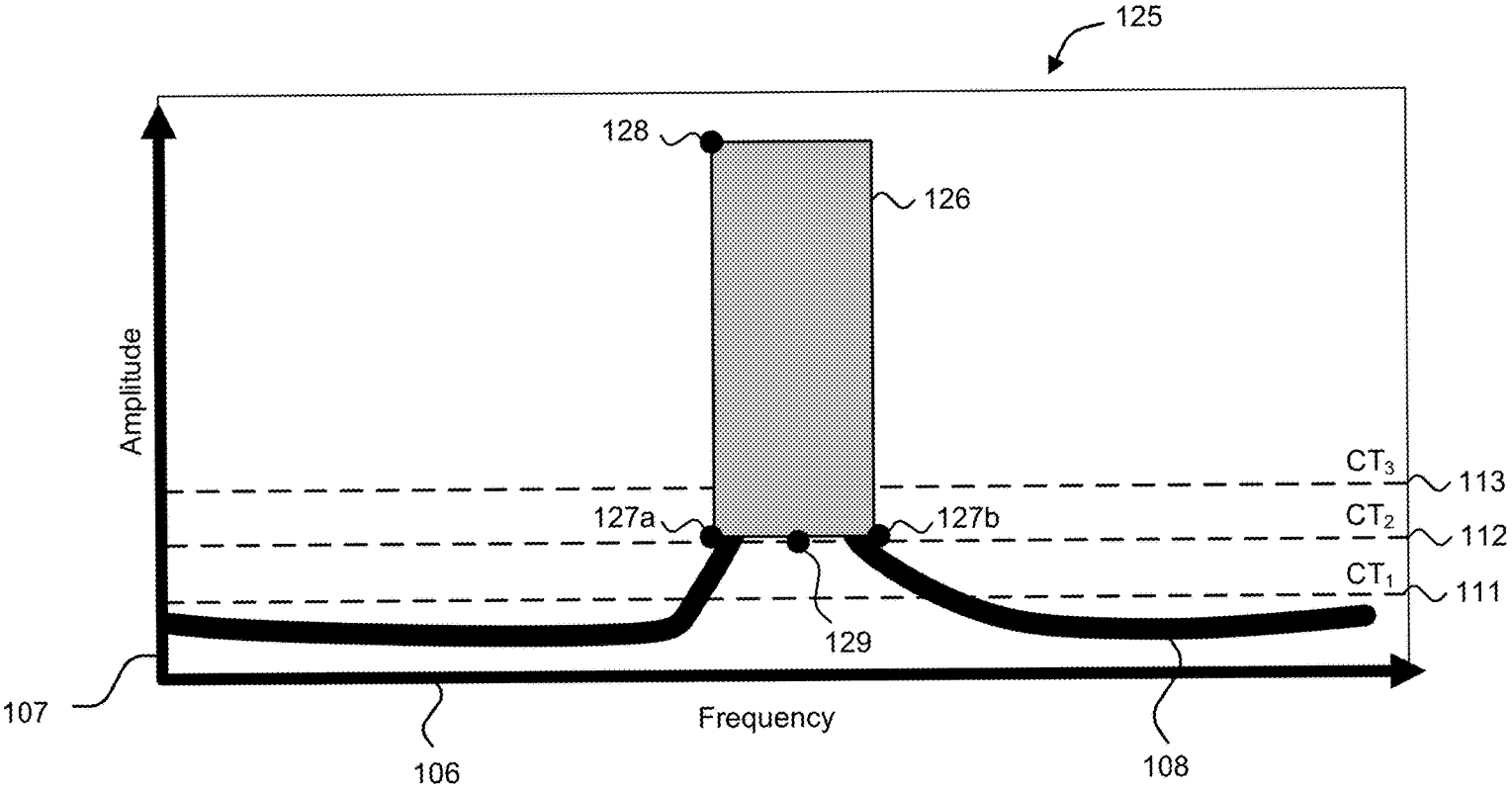
FIG. 12 is a block diagram showing, by way of example, a graph of the cleaned average power spectrum of FIG. 9B and a trigger region.

Once determined, the trigger regions are represented as subsequences of points defined by endpoints of each contiguous segment, which is stored in the memory of a communication device. FIG. 12 is a block diagram showing, by way of example, a graph 125 of the cleaned average power spectrum 108 of FIG. 9B and a trigger region 126. The x-axis 106 of the graph 125 represents frequency and the y-axis 107 represents amplitude. The trigger region 126 is defined around a portion of the cleaned average power spectrum 108 and is generally larger than the peak region (not shown).

After the trigger region has been defined, an appropriate energy well template is selected (block 86) and applied to a trigger region. The templates are defined prior to training and are scaled to fit an energy well to a particular trigger region. An energy well EW(x) is a classification function that determines whether a peak within a training sound matches a peak within a trigger region for an observed sound. Different classification functions can be used for the energy well, such as parabolas, sine, cosine, piecewise functions, and functional transforms on the spectrum. A profile generated from a training signal will have the same number of energy wells as significant peaks, peak regions, and trigger regions.

Figure 13:
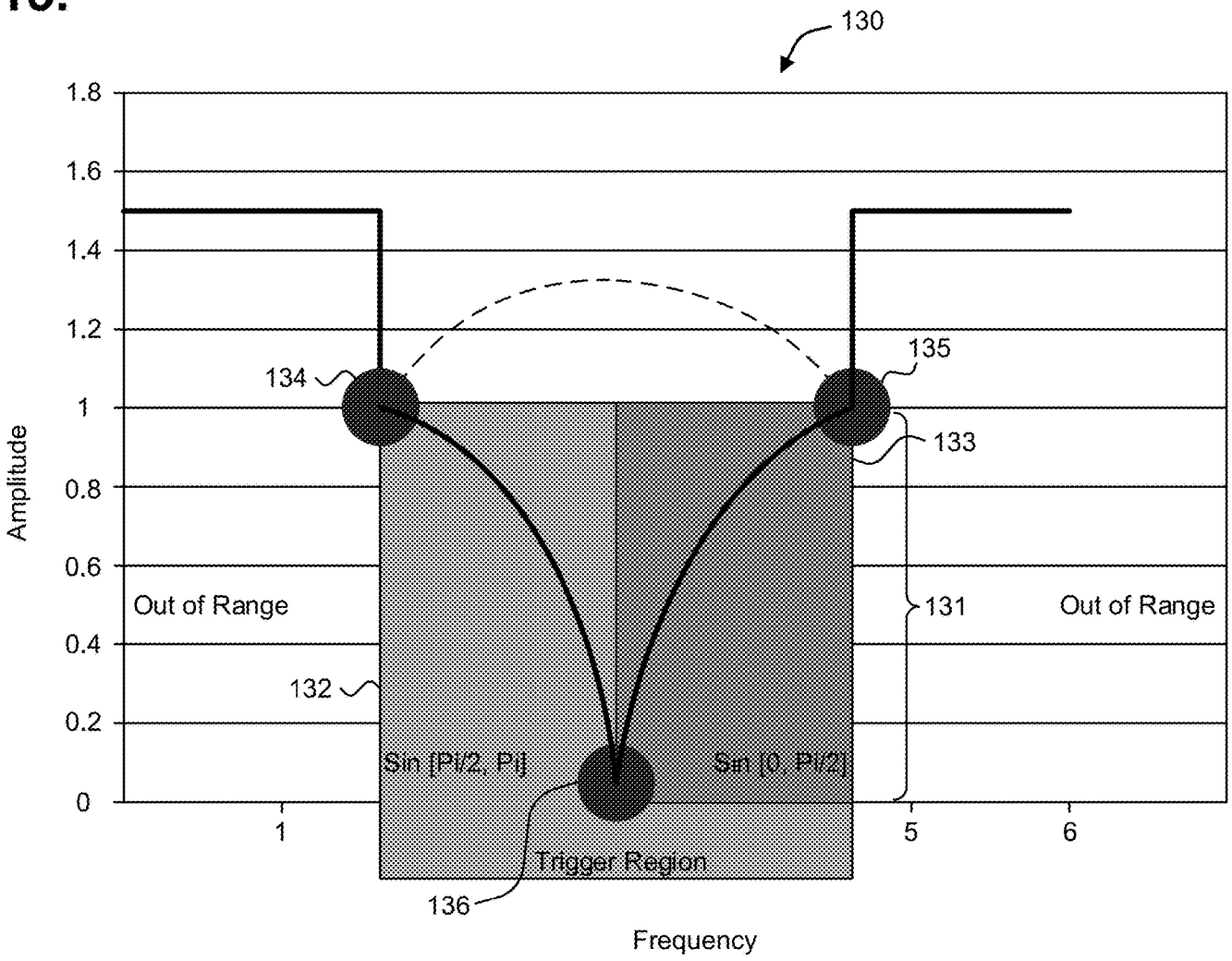
FIG. 13 is a block diagram showing, by way of example, a graph of an energy well template.

An energy well template has a common interface specified by a set of placeholder parameters that define how an energy well is anchored to a location on a power spectrum for the training sound at a trigger region. The placeholder parameters also define how the energy well template is stretched along the x-axis and the y-axis of the trigger region, filling the entire rectangle. An energy well template interface is specified as: $EW_{Template}(X_{Ta}, X_{Tp}, X_{Tb}, Y_{min}, Y_{max})$. FIG. 13 is a block diagram showing, by way of example, a graph 130 of an energy well template 131. The energy well can define the following relative, template landmarks, associated with one embodiment, using a piecewise sine wave. The energy well template ($EW_{Template}$) 131 is graphed along an x-axis that represents frequency and a y-axis that represents amplitude and is represented as ($X_{Ta}$, $X_{Tp}$, $X_{Tb}$, $Y_{min}$, $Y_{max}$). $X_{Ta}$ 134 represents a left frequency bound for the energy well template and $X_{Tb}$ 135 represents a right frequency bound for the template. $X_{Tp}$ 136 represents a position of peak frequency for the template. Meanwhile, $Y_{min}$ 136 represents a minimum trigger energy for the energy well template that occurs at $X_{Tp}$. $Y_{max}$ is a maximum trigger energy for the energy well templates, which can occur at $X_{Ta}$ and $X_{Tb}$.

Each energy well profile can be determined using the following equation for a piecewise sine wave energy well:

$$f(x) = \begin{cases} g_{left}(x) : \{x \in R \mid X_{Ta} \le x \le X_{Tp}\} \\ g_{right}(x) : \{x \in R \mid X_{Tp} < x \le X_{Tb}\} \end{cases} \quad \text{Eq. 10}$$

$$g_{left}(x) = \sin\left[\left(\frac{\pi}{2} - \pi\right) \times \frac{(x - X_{Ta})}{(X_{Tp} - X_{Ta})} + \pi/2\right] \quad \text{Eq. 11}$$

$$g_{right}(x) = \sin\left[\left(\frac{\pi}{2}\right) \times \frac{(x - X_{tp})}{(X_{Tb} - X_{Tp})}\right] \quad \text{Eq. 12}$$

where R in Equation 10 represents a trigger region to which the energy well is anchored. A value of x selected along the energy well must be positioned within the trigger region. The output range of f(x) is $\{0 \le y \le 1\}$. The parameters specified by the energy well template: $X_{TA}$, $X_{TP}$, $X_{TB}$, are landmarks of the energy well template that have specific filter characteristics for a particular detection context. More specific contexts will be determined through later engineering experiments. Other functions for determining energy wells are possible.

The energy well template 131 includes a left range 132 and a right range 133, which meet at a peak point ($X_{Tp}$, $Y_{Tmin}$) 136. On one end, the left range 132 is bounded by an energy asymptote defined by a vertical line at $X_{Ta}$ 134 at a minimum frequency. On the other end, the left range 132 is bounded at the peak frequency $X_{Tp}$ 136, at a maximum frequency for the left range 132. The right range 133 is bounded on one end at a minimum frequency, at the peak frequency $X_{Tp}$ 136, and on the other end at an energy asymptote at a vertical line intersecting the maximum frequency $X_{Tb}$ 135. The minimum and maximum frequencies for the energy well template are defined by the left and right asymptotes, which each occur at a common peak amplitude.

Upon determination, an energy well template such as the piecewise sine function of FIG. 13 is anchored (block 87) to each trigger region. Energy wells are assigned to each trigger region by calculating cutoff thresholds, finding a set of trigger regions within the training power spectrum using the CT function outputs, and using a location of the trigger regions and energy of the corresponding training signal peaks to define calibration coefficients for the energy wells, as described above.

Prior to applying an energy well template to a trigger region, energy well calibration coefficients from a training power spectrum are determined. Each trigger region is bound to a particular location on a power spectrum by three points on the X axis: $x_a$, $x_p$, and $x_b$ where $x_a<=x_p<=x_b$, and two points on the Y axis, $CT_2$ at the peak location and $y_p$ the amplitude at the peak location. Referring back to FIG. 12, the landmark $x_a$ 127*a* refers to the left most bound of a trigger region 126 corresponding to its minimum frequency. The landmark $x_b$ 127*b* refers to the rightmost bound of the trigger region 126 corresponding to its maximum frequency. Finally, the landmark $x_p$ 129 refers to the peak location within the trigger region that corresponds to the location of a point on the training power spectrum ($x_p$, $y_p$) such that $y_p$ is the maximum amplitude on the power spectrum contained within the trigger region. Meanwhile, $CT_2$ is represents a minimum amplitude on the power spectrum within the trigger region. The set of values $\{x_a, x_p, x_b, CT_2, y_p\}$ represent a collection of calibration coefficients that will be used to anchor an energy well template to this trigger region. The selected energy well template is anchored to a trigger region by stretching across an area of the trigger region rectangle both on the x- and y-axis. Recall, an energy well template has a corresponding set of placeholder parameters: $\{X_{Ta}, X_{Tp}, X_{Tb}, Y_{min}, Y_{max}\}$. The corresponding parameters discovered for a trigger region, as shown in the previous paragraph, are substituted into the placeholder parameters of the energy well template, such that the energy well ($EW_{Achored\ at\ TR\ i}$) is anchored at the trigger region with the coefficients ($x_a$, $x_p$, $x_b$, $CT_2$, $y_p$), where $x_a$ is the—left frequency bound of the energy well and $x_b$ is a right frequency bound, which bounds are the same as the trigger region to which the energy well is anchored. $x_p$ is a position of peak frequency, which is the same as the trigger region. $CT_2$ is a minimum energy associated with signal statistics, which is the same as the trigger region and $y_p$ is a maximum amplitude for the peak within the trigger region.

Figure 14:
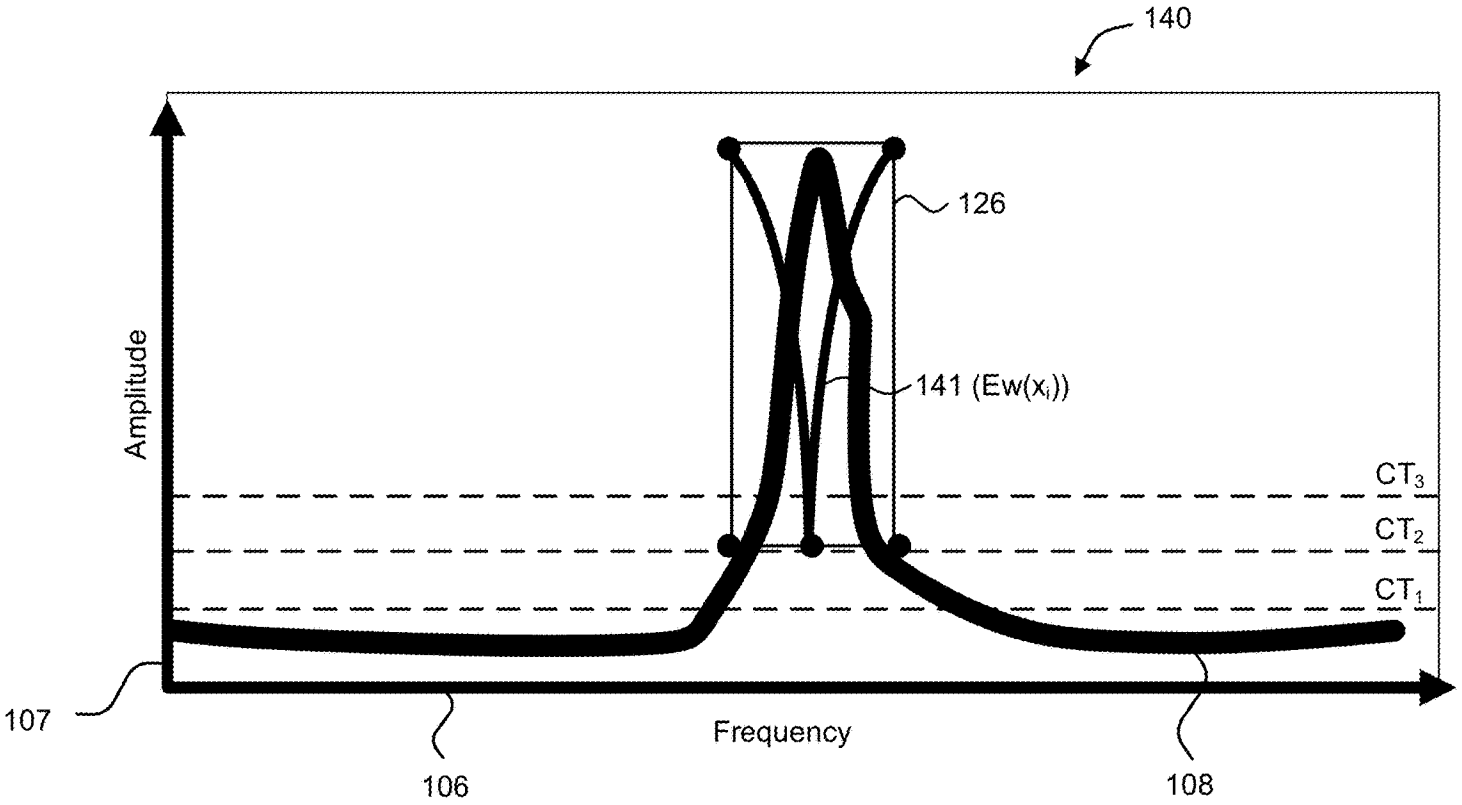
FIG. 14 is a block diagram showing, by way of example, a graph of the cleaned average power spectrum and trigger box of FIG. 12 with an anchored energy well template.

FIG. 14 is a block diagram showing, by way of example, a graph 140 of the cleaned average power spectrum and trigger box of FIG. 12 with an anchored energy well template 141. The energy well template 141 when applied to a corresponding trigger region's calibration coefficients is placed within the trigger region 126. The energy well trigger region is a subset of the power spectrum that is searched for a match of an observed sound. Once determined, the coefficients associated with the energy well template, the trigger region, the cutoff thresholds, and the observation temperature are stored to a training profile for the sound as a frequency only profile 88, as shown in FIG. 7.

The energy well can be used as a filter query on an array representation of the cleaned average power spectrum to help identify a sound match. Only those frequencies that are contained within the trigger regions are searched using the energy well. During the search, amplitudes for each point are tested against the corresponding energy well's expectation amplitudes. The minimum expectation amplitude refers to a minimum amount of energy that an observed signal must have at a corresponding frequency for the observed signal, having a peak at a common expected location, to trigger the corresponding energy well. The maximum expectation amplitude refers to a maximum energy at the energy well boundaries allowing for triggering of a frequency shifted peak in an observed signal only if the peak is within the trigger region and the amplitude is greater than the energy well maximum. In one embodiment, a default maximum expectation amplitude is a height of the maximum peak within that trigger region identified during training.

Each sound has a distinct pattern of peaks within a corresponding power spectrum. Using the Pareto principle or the 80/20 rule, only a subset of highest amplitude peaks within a power spectrum need be used to perform an initial match of the sound represented by the power spectrum with a sound, such as observed in the environment. For example, only 20% of the signal peaks are responsible for generating 80% of the signal's power and thus, 20% or less of the signal data is required to make an accurate classification, which results in a corresponding set of mutually exclusive trigger regions. As described below in detail with reference to FIG. 18, an energy well is triggered if a point ($x_i$, $y_i$) is included within the domain of an energy well function as shown in Equation 8 below and the point has an amplitude ($y_i$) greater than or equal to the energy well function as shown in Equation 9, as provided below:

$$x_a \geq x_i \geq x_b \quad \text{Eq. 13}$$

$$y_i \geq EW_j(x_i) \quad \text{Eq. 14}$$

The values for $x_a$ and $x_b$ represent left and right boundaries of an energy well function that correspond with the boundaries of the associated trigger region. Determining a sound match is further described below with references to FIGS. 17 and 18.

Figure 15:
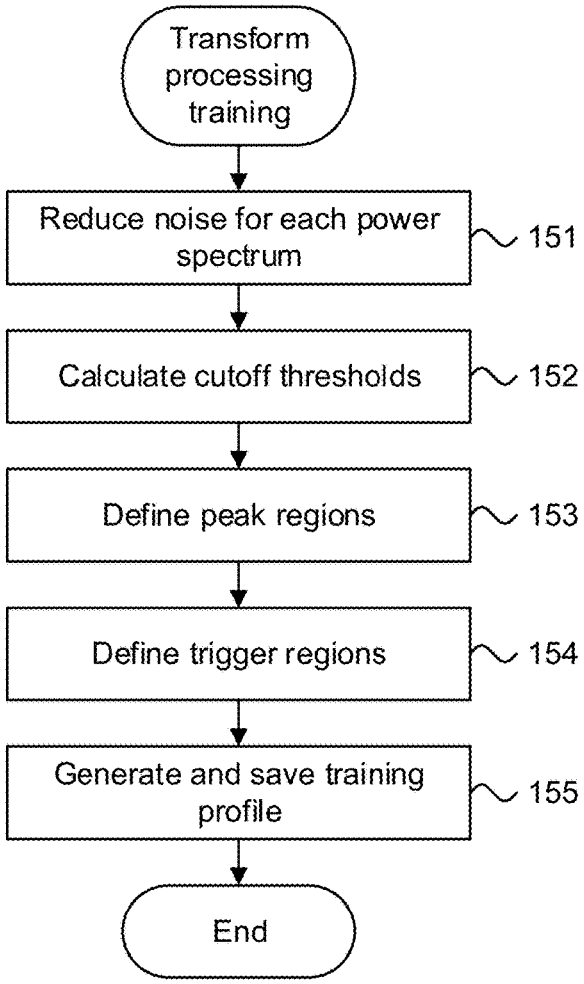
FIG. 15 is a flow diagram showing, by way of example, a process for determining a signal profile.

In addition to the energy well profile, the training profile also includes an STFT profile. The energy well, as described above with respect to FIGS. 7-14, focuses on maximizing a clarity of a frequency signature, while disregarding time. However, STFT analysis focuses on applying a frequency analysis more leniently in combination with low granularity time processing, such as sequence matching. FIG. 15 is a flow diagram showing, by way of example, a process 150 for determining a signal profile. The stratified windows of the training sound, described above with respect to FIGS. 5 and 6 are accessed. As described above, the windows can be stratified based on the maximum frequency and number of samples.

Using STFT, one or more parallel stacks of power spectra are computed by generating several time series channels from the sound with each time series channel offset from the other time series channels. The stack of power spectra represent a sequence in time of mutually exclusive and contiguous sequence of stratified blocks that are the same size. A stack has a default initial time position of zero, which starts immediately at the point at which the time series was sampled. For example, when a training button is pushed on a communication device, data flows into the device via a microphone, the first datum is included in the first stratified time series block. The time series channel is an additional sequence in time of mutually exclusive and contiguous sequence of stratified blocks of the same size. The difference is that the first datum and potentially other time samples are not included since there is a time offset that makes stratified blocks from different channels overlap one another. By changing time offsets and generating new stacks of power spectra, the granularity of the STFT operation can be influenced. In a further embodiment, the time series can be stretched so that artificially the block size decreases and the time resolution is increased. Other methods for influencing the STFT are possible.

A single average frequency spectrum frame set can then be computed using an alignment in time to calculate weighted averages between temporally overlapping frames.

Each of the stratified time windows generates an array of amplitudes. When a stack of stratified time series windows is generated, a time offset of the windows is recorded and saved. In one example, the time series is 10 seconds long and a window width is two seconds. Thus, the time series would include five, two second windows. A time anchor is represented by a left window bound, which refers to a minimum time included in a time series block. The power spectra associated with each block represents frequency and amplitude as described above. The frequency and amplitude measures can be bound to a two second time window in time according to the above example. So, for every two seconds, a spectrum appears. When sorted in time, time series changes in frequency can be understood, but only at a two second granularity. As the size of the time block is reduced, the maximum frequency is also reduced. Thus, to increase the time granularity, the windows can be recalculated at different positions in time or stretching of the time series can occur, as described above.

Figure 22:
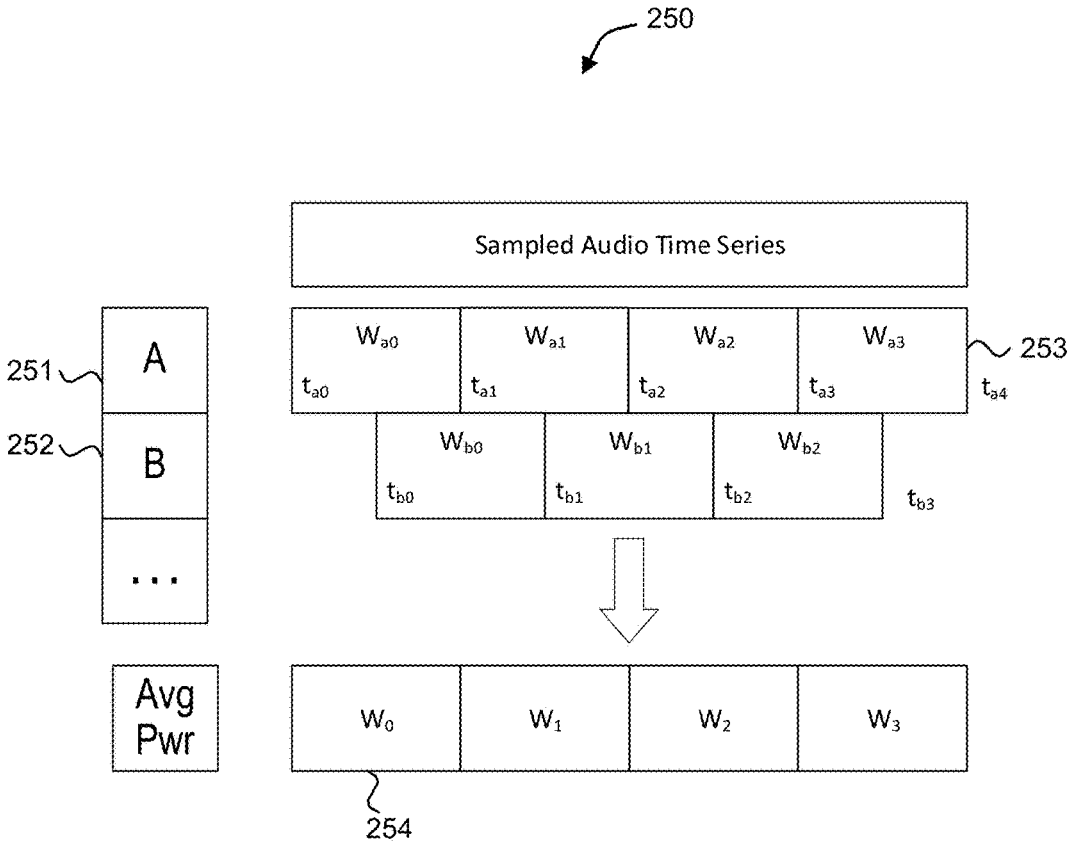
FIG. 22 is a block diagram showing a time offset record.

The time offset is recorded for each of the stratified windows in a channel based on the left window bound and used to generate an average power spectrum between corresponding offset windows. Each of the windows within a channel are mutually exclusive. For example, FIG. 22 is a block diagram showing a time offset record 250. In the time offset record, channel A 251 represents a time offset of zero, while channel B 252 represents a time offset of $t_{bo}$.

W represents a stratified window 253 and t represents a time offset. Each window is also identified by a subscript for the channel to which the window belongs and the time offset. Subsequently, an average power spectrum ($W_i$) 254 is determined for each of the stratified windows 253 having overlapping windows in time between channels. For example, an average power spectrum $W_0$ can be determined based on the power spectra of the first stratified window, $W_{a0}$ and $W_{b0}$, in each channel A and B, and the average power spectrum $W_1$ is determined based on the set of power spectra overlapping $W_{a1}$ in the second stratified window in each channel, and so on until all the average power spectra have been determined.

The weighted average power spectra between the windows can be determined by using the following equations:

$$W_0 = \frac{(1 \times Pwr(W_{a0})) + (|t_{a1} - t_{b0}| Pwr(W_{b0}))}{1 + |t_{a1} - t_{b0}|} \quad \text{Eq. 13}$$

$$W_1 = \frac{(1 \times Pwr(W_{a1})) + (|t_{a1} - t_{b1}| Pwr(W_{b0})) + (|t_{a2} - t_{b1}| Pwr(W_{b1}))}{1 + |t_{a1} - t_{b0}| + |t_{a2} - t_{b1}|} \quad \text{Eq. 14}$$

$$W_i = \frac{(1 \times Pwr(W_{ai})) + (|t_{ai} - t_{bi}| Pwr(W_{bi-1})) + (|t_{ai+1} - t_{bi}| Pwr(W_{bi}))}{1 + |t_{ai} - t_{bi}| + |t_{ai+1} - t_{bi}|} \quad \text{Eq. 15}$$

$$W_n = \frac{(1 \times Pwr(W_{an})) + (|t_{an} - t_{bn}| Pwr(W_{bn-1}))}{1 + |t_{an} - t_{bn}|} \quad \text{Eq. 16}$$

where Pwr represents a function that computes the power spectrum for a stratified window, as described above. $W_0$ orepresents the average power spectrum for the first time offset, $W_1$ Irepresents the average power spectrum for the second time offset, $W_i$ represents the average power spectrum for the ith time offset, and $W_n$ represents the average power spectrum for the last time offset.

Once the stratified windows and their corresponding power spectra are obtained, the noise of each average power spectrum is reduced (block 151) to generate a cleaned representation. Reducing the noise is described above in further detail with respect to FIG. 7. Subsequently, cutoff thresholds are calculated (block 152) for the average power spectra, and the cutoff thresholds are used to determine a peak region (block 153). In one embodiment, three cutoff thresholds are defined for each average power spectrum and the peak regions cover a rectangular area in which the peak of that average power spectrum is included. The peak regions are bounded on each end and based on the intersection of the spectrum with the third cutoff threshold associated with the highest amplitude an on the other end by the peak. Other embodiments are possible. Calculating the cutoff thresholds and defining the peak regions are described above in detail with respect to FIGS. 7, 10, and 11. Next, trigger regions are determined (block 154) for each average power spectrum. The trigger regions each represent a bounding box that is larger than the peak regions to accommodate frequency shifts that can be caused by environmental conditions in which a sound is transmitted and observed. The trigger regions can be determined by finding an intersection of each average power spectrum with the most appropriate cutoff threshold, such as $CT_2$. Further details regarding determining the trigger regions are described above with respect to FIGS. 7 and 12. An STFT profile is generated (block 155) by storing the cutoff thresholds and frequency ranges for the trigger regions for each average power spectrum representation in memory. The STFT profile is combined with the data from the frequency only profile to complete the training profile for the training sound.

Figure 16:
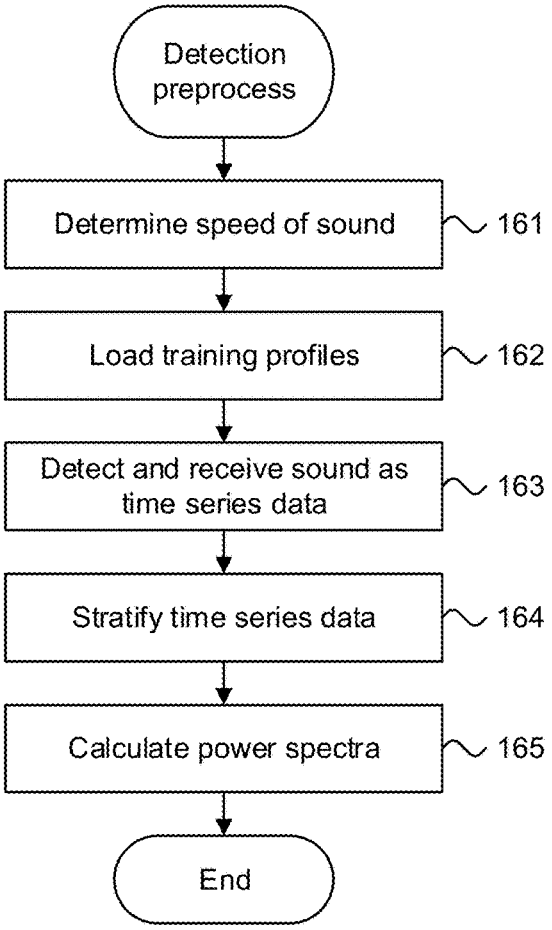
FIG. 16 is a flow diagram showing, by way of example, a process for preprocessing an observed sound.

Once the training profile has been generated for a training sound, the profile is stored by a communication, or specialized, device, such as a fire alarm, fire extinguisher, sign, picture frame, or mirror, as well as other types of devices, on which the training sound was loaded. In one embodiment, the training profiles of different communication devices can be exchanged between the devices over a network, such as a mesh network. The communication device can act as a detector to observe sounds within the environment and determine whether the observed sound matches a sound associated with a training profile stored on the communication device. Prior to comparing the observed sound to the training profile, the observed sound must be preprocessed to generate a representation of the observed sound as a power spectrum. FIG. 16 is a flow diagram showing, by way of example, a process 160 for preprocessing an observed sound. A temperature is detected and a speed of sound is calculated (block 161) based on the temperature. Subsequently, training profiles are accessed (block 162) and one or more sounds within the environment are detected (block 163). The sounds observed by the communication device can be received via a microphone or auxiliary line as input streams, WAVE files, and MP3s, as well as via other means. At a minimum, input of the observed sound should provide corresponding time series data for the sound. The time series data is then stratified (block 164), or divided, into a series of windows that each represent snapshots in time of a signal, such as an observed sound. Stratifying the time series data is described above with respect to FIG. 6. For each stratified window, a power spectrum is calculated (block 165) for the subset of sound represented in that window.

Figure 17:
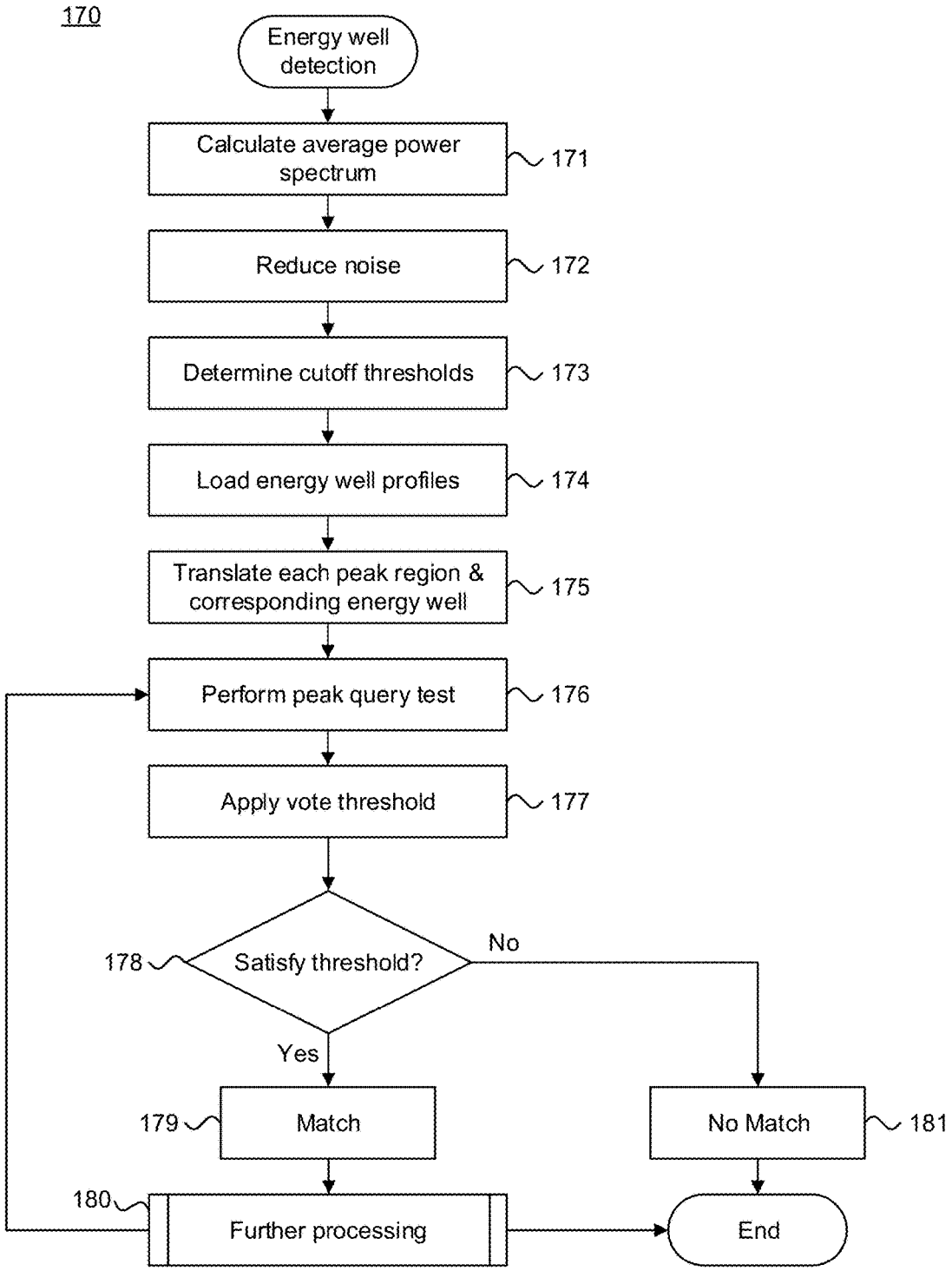
FIG. 17 is a flow diagram showing, by way of example, a process for comparing an observed sound to the frequency only profile of FIG. 7.

Once the power spectra have been determined for each of the stratified windows, the observed sound can be compared with one or more training profiles stored on the communication device to determine whether the observed sound matches one of the profiles. Comparing the observed sound to a training profile occurs in two steps. The first step includes comparing the observed sound with the frequency only profile and the second step includes comparing the observed sound with the STFT profile. FIG. 17 is a flow diagram showing, by way of example, a process 170 for comparing an observed sound to the frequency only profile of FIG. 7. The power spectra of the stratified windows for the observed sound are averaged to determine (block 171) a single average power spectrum. Noise is reduced (block 172) within the average power spectrum by applying noise reduction techniques, such as a moving average or wavelet noise reduction, as further described above with reference to FIGS. 7, 9A, and 9B. Cutoff thresholds are determined (block 173) for the average power spectrum of the observed sound and determining the cutoff thresholds is described above with reference to FIG. 7.

To perform a comparison between the observed sound and the training sound, the frequency only profiles are accessed (block 174) memory. However, prior to comparing the profile for the observed sound with the training profiles, the power spectrum of the training profile should be calibrated according to the speed of sound, which is estimated based on a temperature of the environment in which the communication device is located, and signal statistics, such as a mean and standard deviation of the power spectra. Specifically, each trigger region and corresponding energy well can be translated (block 175) to the center peak frequency of the observed sound and dilated according to left and right window boundaries. With regard to the training profiles, each training profile has one or more energy wells, which are associated with corresponding left, peak, and right landmarks that each represent frequencies on the power spectrum that occurred at the training temperature. If the temperature measured for the sample sound and the observed sound is constant, an expected location to "superimpose" an energy well from the training profile onto a power spectrum for an observed sound is identical to the positions defined by the training profile for the left and right boundaries, and the peak maximum. However, if the temperature is different, a frequency shift caused by a change in temperature should be calculated since frequency shifts caused by a change in temperature are not constant. New left and right boundaries and a peak maximum along the frequency axis should be calculated for expected locations at the different temperature. Specifically, for each of the left and right boundaries of the trigger region, an expectation of an observation frequency for the observed sound can be calculated based on a training frequency at a training temperature and an observation temperature using the following equation:

$$f_{obs,}(T_{obs}, T_{train,} f_{train,}) = \frac{\sqrt{T_{obs}}}{\sqrt{T_{train}}} \times f_{training} \quad \text{Eq. 17}$$

where $T_{obs}$ represents a temperature of the environment during loading of the observed sound, $T_{train}$ represents a temperature of the environment during loading of the training sound, $f_{train}$ represents a frequency of the training sound, and $f_{obs}$ represents a frequency of the observed sound. The expected observation frequency is then used to translate the associated boundary of the trigger region to the expected location. For example, an expected peak maximum frequency is used to center the peak region at the expected location. Further, energy wells can be scaled using a linear transform for the left and right segments using reference landmarks between spectra. An example of a linear scaling between spectra is described next.

Within a trigger region of a training profile, a minimum value for an energy well $e_{min}$ and a maximum value for the energy well $e_{max}$ are determined. The minimum value can equal the second cutoff threshold, while the maximum value can equal the third cutoff threshold. An output value, outvalue, for an observation sound is determined via a linear transform that uses an input value, invalue, from the training profile scale and converts the input value to the output value for the observation sound, according to the equation below:

$$outvalue = \frac{q_{max} - q_{min}}{e_{max} - e_{min}} \times invalue + q_{min} \quad \text{Eq. 18}$$

where $q_{min}$ s a known minimum energy that is equal to the second cutoff threshold for the observed sound and $q_{max}$ is an estimated value that is equal to the third cutoff threshold for the observed sound. An energy well associated with a training profile can be scaled to fit a corresponding location within the average power spectrum for the observed sound.

Figure 18:
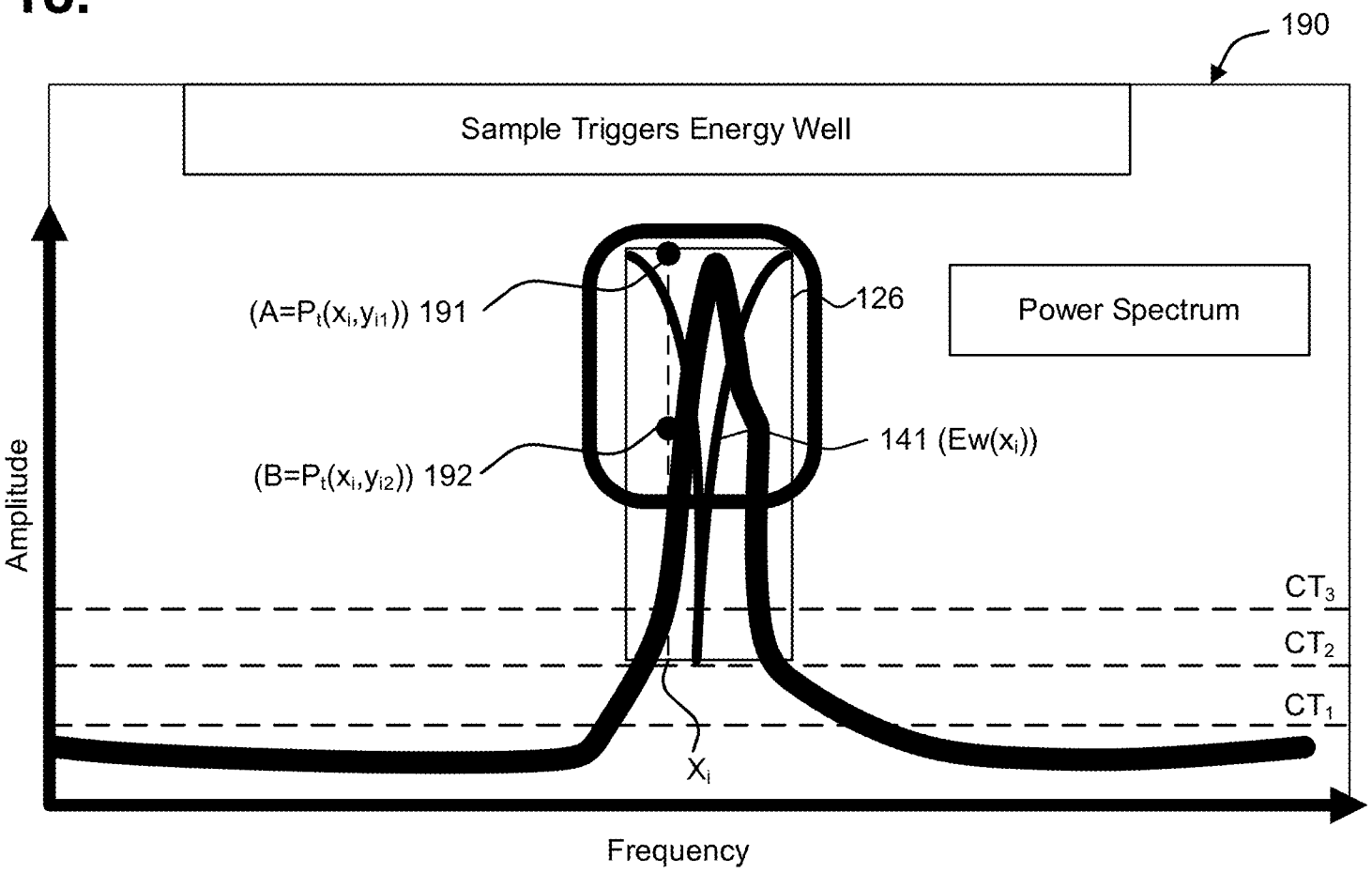
FIG. 18 is a block diagram showing, by way of example, a graph of the average power spectrum, trigger region, and energy well applying the peak query test.

Next, a peak query test is performed (block 176). FIG. 18 is a block diagram showing, by way of example, a graph 190 of the average power spectrum, trigger region, and energy well applying the peak query test. The peak query test attempts to find an amplitude within the average power spectrum of the observed sound that is greater than or equal to an expectation value defined by a scaled energy well. One or more points within the average power spectrum for the observed sound are sampled if they fall within the frequency range defined by the trigger region. The points of the power spectrum within a trigger region frequency domain have their amplitudes compared with the expectation amplitude defined by the energy well at each corresponding frequency.

A vote is tallied for the observed sound when the amplitude of the average power spectrum for the input sound equals or exceeds an amplitude of the energy well. Specifically, if at least one point along the average power spectrum and located within the trigger region has an amplitude greater than or equal to the energy well amplitude at the corresponding frequency, then the query stops and a vote count is incremented. Alternatively, if no point along the average power spectrum that is located within the trigger region has an amplitude greater than or equal to the energy well amplitude at the corresponding frequency, then the vote count is not incremented for that trigger region. For example, a point 191, 192 is identified having a value $x_i$ along an x-axis of the graph 190. When the y-value $y_{i1}$ of the point $(P_t(x_{i1}, y_{i1}))$ 191 is above the energy well, a vote count is incremented. However, when the y value $y_{i2}$ of the point $(P_t(x_{i1}, y_{i2}))$ 192 has a lower amplitude than the energy well, the vote count is not incremented for the trigger region.

Each average power spectrum can have many potential trigger regions, as described above with respect to the training profile. A peak query is performed for each distinct trigger region. After all trigger regions have been processed, the vote count (VC) is totaled and then compared to a threshold (block 178), such as a minimum number of votes sufficient for identifying a match between the observed sound and one of the training profiles. The minimum number of votes threshold is based on a maximum score (MS) and a voting percentage parameter (VPP). The MS is defined by the number of trigger regions discovered in the training phase, while the VPP is a predefined parameter that is used to calculate a minimum number of votes needed to confirm a match between the observed sound and one of the training profiles according to the following equation:

$$VC \geq VPP*MS \quad \text{Eq. 19}$$

In one embodiment, the VPP can be set to 50%. However, other values are possible.

If the vote count is equal to or greater (block 178) than the threshold, a match is identified (block 179) and further analysis of the observed sound is continued by comparing the observed sound with the STFT profile. Alternatively, if the vote count fails to satisfy the threshold (block 178), the detection analysis is terminated and a finding is made that no match exists (block 181).

Figure 19:
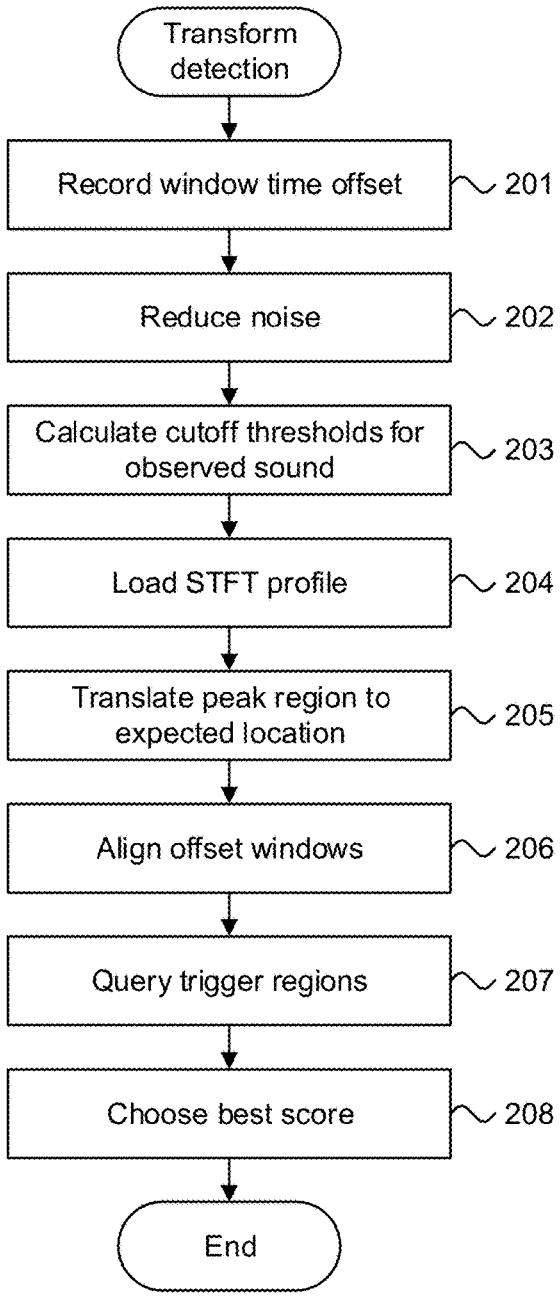
FIG. 19 is a flow diagram showing, by way of example, a process for comparing an observed sound to the signal profile of FIG. 8.

During the STFT phase of detection, a change in peak frequency over time is analyzed to determine if a best fit time aligned sequence meets a user-defined threshold. FIG. 19 is a flow diagram showing, by way of example, a process 200 for comparing an observed sound to the STFT profile of FIG. 8. A window time offset is recorded (block 201) for each power spectrum within the stratified windows. Specifically, a time marker represents a relative location, such as a start, end or some other point of the stratified window that is used to determine a sequential order of the power density spectra of each stratified window. The time can be represented as clock time, a sample number, or a functional transform using time or sample number within the time series stratified windows. Next, one or more noise reduction techniques are applied (block 202) to the power density spectra of each stratified window. The noise reduction techniques can include determining a moving average for each point in the power density spectra of the stratified windows. Subsequently, each corresponding moving average point is subtracted from the associated point along the power density spectrum. The result is a baseline noise correction. Other techniques are possible as described above with respect to FIG. 7.

Cutoff thresholds for each of the stratified windows of the observed sound are determined (block 203). After, the training STFT profiles are loaded (block 204) for comparing with the stratified windows of the observed sound. However, prior to the comparison, the frequency spectrum of the training STFT profiles should be calibrated to the speed of sound. Each peak region and corresponding energy well of the stratified windows for the STFT profiles can be translated (block 205) to a center peak frequency of the power spectra for the stratified windows of the observed sound as described above with respect to FIG. 17. Further, the peak region and energy well can be dilated according to left and right window boundaries.

The stratified windows of the STFT profile are aligned (block 206) with the stratified windows of the observed sound in a matrix. Since the number of time windows in a training STFT profile is equal to a number of time windows for an observed sound, the stratified windows can be compared using an n×n matrix of potential time sequence combinations from which a set of distinct peak queries can be identified. The windows are ordered within the matrix by time, which occurs at a summary level of granularity by generating an overview of matches over all the power spectra.

The trigger regions of the STFT profile are applied to the stratified windows of the observed sound within a single frame and queried (block 207) to determine whether a match exists between stratified windows of the training sound and the observed sound. Specifically, when a peak of the power spectrum of a stratified window for the observed sound is within the trigger region of a stratified window from the training STFT profile and $y_i >= CT_2(x_i)$, a vote is assigned, as described above with reference to FIG. 17. The peak comparison is performed for each combination of stratified windows provided by the matrix. A VPP is utilized with a count of the votes to determine whether the windows match, as described above with reference to FIG. 17.

Figure 20:
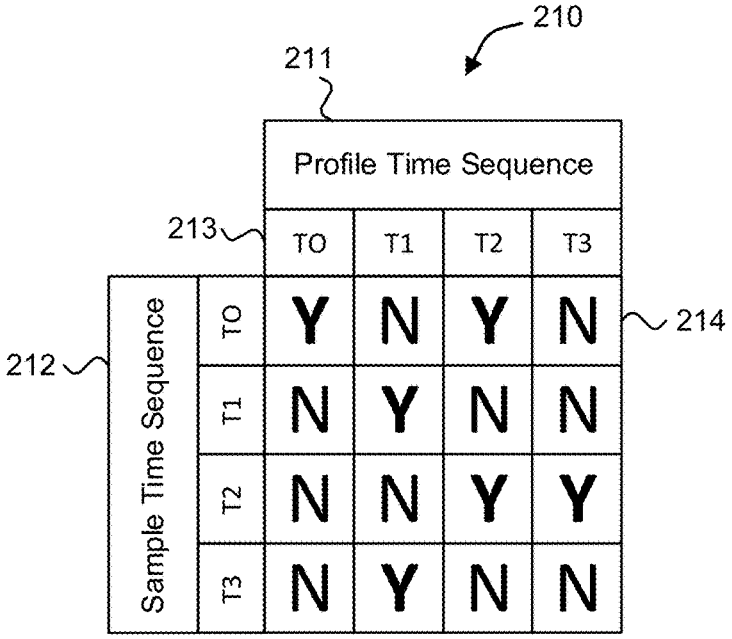
FIG. 20 is a block diagram showing, by way of example, a matrix of stratified windows for an STFT profile and an observed sound.

The windows of the observed sound and STFT profile can be organized in a matrix. FIG. 20 is a block diagram showing, by way of example, a matrix of stratified windows for an STFT profile and an observed sound. In one embodiment, the windows of the STFT profile are aligned along an x-axis in time order, while the windows of the observed sound are aligned along a y-axis in time order. Each box shared by a window from the STFT profile and a window from the observed sound represents a comparison of the windows and a determination as to whether the windows match are indicated within the box. A "Y" indicates that the windows match, while an "N" indicates that the windows do not match.

Figure 21:
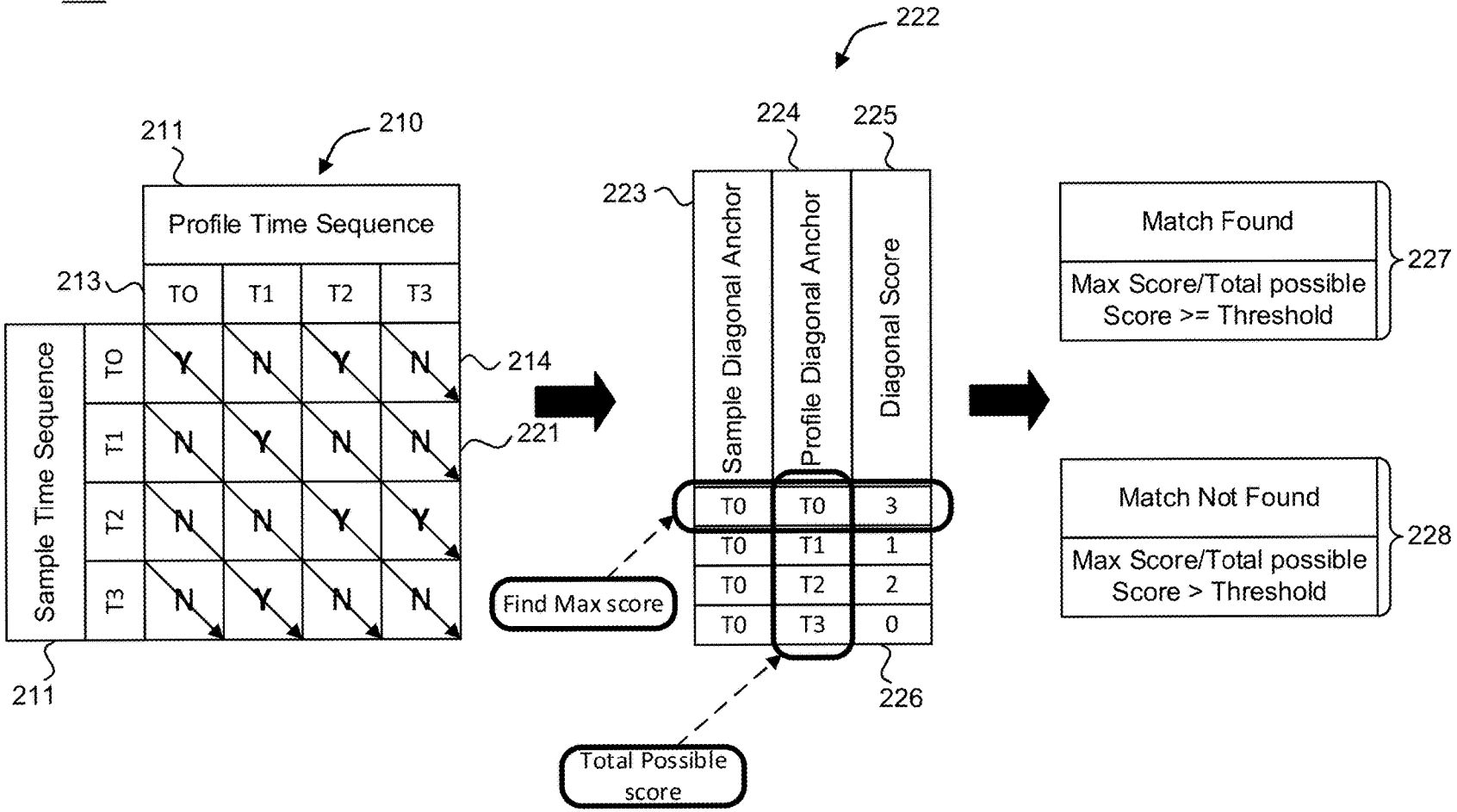
FIG. 21 is a block diagram showing, by way of example, the matrix of FIG. 20 and a scoring table.

The matrix can be used to determine whether a match exists between the observed sound and the sound associated with the STFT profile being compared to the observed sound. FIG. 21 is a block diagram 220 showing, by way of example, the matrix 210 of FIG. 20 and a scoring table. Diagonal traversal paths 221 can be sampled across the matrix 210 to identify windows 214 that are diagonally located to one another and to calculate a diagonal score 225 for the identified windows. The diagonal traversal paths can represent an adjacency of STFT frames in time. If an x-axis of the matrix is traversed from left to right, movement through time relative to the profile occurs. However, if a y-axis is traversed, from top to bottom, in the matrix, movement through time relative to the signal for the observed sound occurs. Thus, to move through time relative to both the training profile and the signal for the observed sound, a diagonal is identified. Each diagonal represents a different starting time characterized by different temporal alignments between the training profile or reference, and an observation sound.

A scoring table 222 records the diagonal scores 225. The score table includes three columns, the first for observation time anchors, the second for profile time anchors and the last for diagonal scores. A observation time anchor is identified as a window for the observed sound that acts as a starting point for the diagonal, while the profile time anchor is a window associated with the STFT profile and acts as a starting point for its diagonal contribution. Meanwhile, the diagonal score is determined by totaling the number of matching windows that occur along the diagonal.

Subsequently, a sound matching score is determined by dividing the maximum score by the total possible score. The maximum score is determined by a number of STFT windows in the profile. When each frame within a training profile matches each corresponding power spectrum frame for the observed sound, an exact match is identified. Each profile frame and power spectrum frame for the observed sound is illustrated by a single cell in the matrix. If the sound matching score is greater than or equal to a predetermined matching threshold, a match between the observed sound and the training sound is identified. However, if the sound matching score fails to satisfy the threshold, no match is identified. In one embodiment, the score is calculated as a percentage of matching frame on a diagonal. If no frames match, a percentage of zero is assigned. In contrast, if all the frames match, a percentage of 100 is applied. Returning to the discussion of FIG. 19, the maximum score is chosen from the list of diagonal scores to determine the best STFT match (block 208). If the maximum score is greater than or equal to the voting threshold, then an STFT match was found and implies a total sound match from the detection workflow. If however, the maximum diagonal score is less than the voting threshold, then no match was found (and the signals may be considered differing in time but similar in overall frequency).

Further, the communication system can be used to notify elderly individuals when the doorbell rings, when a laundry cycle has completed, or other household or business notifications. As well, the communication system can be used to help individuals locate items, such as a pair of glasses. A profile is generated for a sound of the glasses being placed on different materials and when a sound is observed, the observed sound is compared to the glasses sound profiles. If a match exists, a location of the glasses can be determined and relayed to the owner.

In a factory, the communication system can be used to ensure compliance with safety procedures. For example, a factory includes a cleanroom for scientific research in which sensitive products are located. The cleanroom must be entered at certain times to ensure the products do not become contaminated. A sensor located outside the cleanroom can detect a presence of an individual via sound or imaging. The presence triggers a recorded speech phase that plays "do not enter, cleanroom in process." Other examples to ensure compliance are possible.

The communication system can also be useful in for militaries to ensure that soldiers are safe even in enemy environments. For example, each soldier in a platoon can wear a sensor that can recognize the cocking of a gun, enemy attacks codes in English or a language different than English, as well as other sounds. Once one of the sounds is detected via a sensor from at least one individual, the sensors of the other individual soldiers can sound to provide a warning of a potential threat.

Further, the communication system can be used to identify border crossers by placing sensors around a border and training the sensors to identify sounds, such as walking or running on the terrain, or airplane or boat motors, and, as well as other sounds that may indicate an individual is crossing the border.

In addition to sound, the communication system can be used to identify images and trigger an alarm based on a recognized image. For instance, a picture of a coffee mug can be taken. Vertical and horizontal scan lines of the picture are analyzed and an image for a cross section of the cup is recorded. Additionally, a target picture of an environment is taken. Bisection is used to split the target image into segments. Specifically, the target image is divided vertically and then horizontally. Next, a search is performed in each of the segments to determine whether the cross section image of the coffee mug is located in one of the segments. If so, an identification of the segment is provided as an identified location of the mug.

In yet a further embodiment, peak identification and classification can be used in spectroscopy and 2D image processing. Profiles can then be generated to query images for use in biometrics, face detection, object detection, radiology, and disease detection. In one example, a detector can utilize spectroscopy to identify a composition, such as organic compounds. Some type of analytic spectrum representing absorption, emission, or scatter can be processed and compared using a similar methodology. Based on a positive identification an appropriate response can occur, such as classification or an alarm.

While the invention has been particularly shown and described as referenced to the embodiments thereof, those skilled in the art will understand that the foregoing and other changes in form and detail may be made therein without departing from the spirit and scope of the invention.

What is claimed is:

1. A method for sonically connecting communication devices, comprising:

generating for a training sound, a training profile comprising a frequency only profile and a STFT profile, wherein the frequency only profile comprises a set of energy well coefficients, trigger regions and cutoff thresholds, and the STFT profile comprises different trigger regions and different cutoff functions for a plurality of windows for the sound;

storing the training sound profile in a memory of a device; comparing an observed sound received on the device as an alert to the frequency only profile via a processor of the device;

assigning via the processor a vote when at least one point along an average power spectrum for the observed sound is greater than or equal to a threshold defined by one such energy well coefficient;

determining a total number of votes via the processor;

when the total number of votes is greater than or equal to a predetermined minimum number of votes, comparing via the processor an observation power spectrum for a plurality of windows of the observed sound to the STFT profile;

comparing each profile window to each observed sound window via the processor; and determining via the processor that the observed sound matches the sound profile when a predetermined number of matches between the profile windows and the sound observation windows exists.

2. A method according to claim 1, further comprising:

training a specialized device by loading the sound; and generating the sound profile, comprising:

generating a frequency only profile for a sound associated with one such maintained sound profile;

generating an STFT profile for the sound associated with the maintained sound profile; and combining the frequency only profile and the STFT profile as the maintained sound profile.

3. A method according to claim 1, further comprising:

preprocessing the training sound, comprising:

transforming the training sound into a time series representation;

stratifying the time series representation into a plurality of windows;

computing a frequency transform for each window; and computing a power density spectrum based on the frequency transforms for each of the windows.

4. A method according to claim 1, further comprising:

defining the cutoff thresholds, comprising:

obtaining an average power spectrum for the training sound;

determining a first cutoff threshold based on a mean amplitude of the average power spectrum for the training sound;

determining a second cutoff threshold as at least one standard deviation from the mean amplitude; and determining a third cutoff threshold as a higher number of standard deviations from the mean amplitude than the second cutoff threshold.

5. A method according to claim 4, further comprising:

defining one such trigger region, comprising all contiguous points of the average power spectrum for the training sound that is above the second cutoff threshold.

6. A method according to claim 5, further comprising:

defining the energy well coefficients, comprising:

selecting an energy well template; and stretching the energy well template across each trigger region.

7. A method according to claim 1, wherein the devices each comprise one of a fire detector, a fire extinguisher, a picture frame, an exit sign and a thermostat.

8. A method according to claim 1, further comprising:

performing one or more response actions based on the identified match.

* * * * *